US006878028B1

(12) United States Patent
Fujii et al.

(10) Patent No.: US 6,878,028 B1
(45) Date of Patent: Apr. 12, 2005

(54) METHOD OF FABRICATING ELECTRON SOURCE AND IMAGE FORMING APPARATUS

(75) Inventors: Akira Fujii, Yokohama (JP); Fumio Kishi, Aikawa-machi (JP); Hisaaki Kawade, Yokohama (JP); Yoichi Ando, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/523,598

(22) Filed: Mar. 10, 2000

Related U.S. Application Data

(62) Division of application No. 09/300,846, filed on Apr. 28, 1999, now Pat. No. 6,053,791.

(30) Foreign Application Priority Data

May 1, 1998 (JP) ..... 10-122533
Feb. 24, 1999 (JP) ..... 11-047121
Feb. 25, 1999 (JP) ..... 11-049195
Apr. 27, 1999 (JP) ..... 11-120206

(51) Int. Cl.[7] ..... H01J 9/00
(52) U.S. Cl. ..... 445/6; 445/24
(58) Field of Search ..... 445/50, 51, 6, 445/24

(56) References Cited

U.S. PATENT DOCUMENTS 5,593,335 A 1/1997 Suzuki et al. ..... 445/50
5,594,296 A * 1/1997 Mitsutake et al. ..... 313/309
5,929,827 A 7/1999 Isono et al. ..... 345/74
6,336,836 B1 * 1/2002 Suzuki et al. ..... 445/6

FOREIGN PATENT DOCUMENTS

EP 0 620 581 A2 10/1994
EP 0 651 418 A1 5/1995
EP 0 660 357 A1 6/1995
EP 701265 * 3/1996 ..... H01J/9/02
EP 717428 * 6/1996 ..... H01J/9/02
EP 0 726 591 A1 8/1996
EP 0729168 8/1996
EP 0732721 9/1996
EP 732721 A1 * 9/1996
EP 769796 A1 * 4/1997 ..... H01J/9/02

(Continued)

OTHER PUBLICATIONS

W. P. Dyke, et al., "Field Emission", Advances in Electronics and Electron Physics, vol. 8, pp. 89–185, 1956.
C. A. Spindt, et al., "Physical Properties of Thin–Film Field Emission Cathodes with Molybdenum Cones", J. Appl. Phys., vol. 47, No. 12, pp. 5248–5263, 1976.
C. A. Mead, "Operation of Tunnel–Emission Devices", J. Appl. Phys., vol. 32, No. 4, pp. 646–652, 1961.

*Primary Examiner*—Joseph Williams
(74) *Attorney, Agent, or Firm*—Fitzpatrick, Cella, Harper & Scinto

(57) ABSTRACT

A method of fabricating an electron source constituted by a plurality of x-direction wirings arranged on a substrate, a plurality of y-direction wirings crossing the x-direction wirings, an insulating layer for electrically insulating the x- and y-direction wirings, and a plurality of conductive films each of which is electrically connected to the x- and y-direction wirings and has a gap, comprises a conductive film formation step of forming a plurality of conductive films to be connected to the pluralities of x- and y-direction wirings, a grouping step of dividing all the x-direction wirings into a plurality of groups, and a forming step of sequentially performing, for all the groups, a step of simultaneously applying a voltage to all wirings assigned to the same group, thereby forming gaps in the plurality of conductive films. The grouping step includes the steps of assigning a plurality of wirings to each group, and arranging wirings constituting a group between wirings constituting other groups.

15 Claims, 19 Drawing Sheets

FOREIGN PATENT DOCUMENTS

| | | |
|---|---|---|
| JP | 6-12997 | 1/1994 |
| JP | 7-176265 | 7/1995 |
| JP | 7-235255 | 9/1995 |
| JP | 7-320631 | 12/1995 |
| JP | 8-273533 | 10/1996 |
| JP | 8-277294 | 10/1996 |
| JP | 9-073859 | 3/1997 |
| JP | 9-102271 | 4/1997 |
| JP | 9-134666 | 5/1997 |
| JP | 9-298029 | 11/1997 |
| KR | 96-39062 | 11/1996 |
| KR | 100221294 | 6/1999 |

* cited by examiner

METHOD OF FABRICATING ELECTRON SOURCE AND IMAGE FORMING APPARATUS

CROSS REFERENCE TO RELATED APPLICATIONS

This is a division of application Ser. No. 09/300,846, filed on Apr. 28, 1999, now U.S. Pat. No. 6,053,791, issued on Apr. 25, 2000.

BACKGROUND OF THE INVENTION

1. Field of the Invention

The present invention relates to a method of fabricating an electron source, a method of fabricating an image forming apparatus using the electron source, and a forming method.

2. Related Background Art

Conventionally, electron-emitting devices are mainly classified into two types: thermionic and cold cathode elements. Known examples of the cold cathode are field emission type electron-emitting devices (to be referred to as FE type electron-emitting devices hereinafter), metal/insulator/metal type electron-emitting devices (to be referred to as MIM type electron-emitting devices hereinafter), and surface-conduction type electron-emitting devices.

Known examples of the FE type electron-emitting devices are disclosed in W. P. Dyke and W. W. Dolan, "Field Emission", Advance in Electron Physics, 8, 89 (1956) and C. A. Spindt, "Physical Properties of Thin-Film Field Emission Cathodes with Molybdenium Cones", J. Appl. Phys., 47, 5248 (1976).

A known example of the MIM type electron-emitting devices is disclosed in C. A. Mead, "Operation of Tunnel-Emission Devices", J. Appl. Phys., 32, 646 (1961).

An example of the structure and fabrication method of the surface-conduction type electron-emitting devices is disclosed in Japanese Patent Application Laid-Open No. 7-235255. This application also discloses an example of an electron source constituted by arranging many surface-conduction type electron-emitting devices on a substrate, and an image forming apparatus using this electron source.

The surface-conduction type electron-emitting device will be briefly explained. FIG. 10 is a schematic (plan) view showing the structure of a surface-conduction type electron-emitting device. A pair of device electrodes 2 and 3 are arranged on a substrate 1 to face each other, and a conductive film 4 is formed to be connected to both the device electrodes. An electron emitting region 5 is formed in the conductive film. In FIG. 10, the electron emitting region 5 is straight near the center between the device electrodes. In practice, the electron emitting region 5 may be bent or formed close to one device electrode.

Japanese Patent Application Laid-Open No. 7-235255 further discloses a more detailed structure of the surface-conduction type electron-emitting device. FIG. 11 schematically shows the section of the electron-emitting device. A gap is formed in part of the conductive film 4, and a film 6 containing carbon as a principal ingredient is formed around the gap.

As shown in FIG. 11, the film 6 containing carbon as a principal ingredient is formed in at least the gap of the conductive film 4.

The gap in part of the conductive film is formed by applying a voltage between the device electrodes 2 and 3 and flowing a current through the conductive film 4. The process of flowing a current and forming a gap in the conductive film is called an "energization forming process" or simply "forming process". The voltage applied in the "forming" process is a pulse voltage or the like, as disclosed in Japanese Patent Application Laid-Open No. 7-235255. Japanese Patent Application Laid-Open Nos. 7-320631 and 7-176265 disclose methods of performing this forming process in forming a plurality of electron-emitting devices.

Japanese Patent Application Laid-Open Nos. 6-12997 and 9-298029 disclose that the forming process is done for a conductive film made of a metal oxide in an atmosphere containing a reducing gas such as hydrogen gas, thereby reducing power necessary for the forming process and more effectively forming the gap.

The process of forming the film 6 containing carbon as a principal ingredient is called an "energization activation" process or simply "activation" process. The activation process is executed by setting, e.g., an electron-emitting device having undergone the forming process in an organic-gas-containing atmosphere and repeatedly applying a pulse voltage between a pair of device electrodes.

Japanese Patent Application Laid-Open Nos. 9-73859 and 9-134666 disclose methods of performing the activation process for a plurality of electron-emitting devices.

The present applicant proposed an electron source formed by arranging many electron-emitting devices on a substrate and wiring them in a matrix as schematically shown in FIG. 12. The above-mentioned patent applications field by the present applicant 20, also disclose electron sources having this structure. For descriptive convenience, a wiring 12 extending in the lateral direction in FIG. 12 will be referred to as an x- or row-direction wiring 12, and a wiring 13 extending in the longitudinal direction will be referred to as a y- or column-direction wiring. At an intersection of the x- and y-direction wirings, an interlayer insulating layer (not shown) is formed to electrically insulate from each other.

SUMMARY OF THE INVENTION

In performing the forming process for the matrix-like electron source, for example, a pulse voltage is applied to x-direction wirings while all y-direction wirings are grounded.

In terms of the fabrication time, the forming process is ideally done for all conductive films at once. However, this method increases a current amount flowing through the wiring and the influence of a voltage drop at the wiring, and varies the forming voltage applied to respective conductive films, resulting in nonuniform shapes of gaps formed in the conductive films. As a result, the device characteristics vary. In the worst case, the wiring is damaged. As for the fabrication apparatus, a device for applying the forming voltage must be increased in current capacity. Because of these problems, this forming method is undesirable.

If the number of electron-emitting devices are arranged on the substrate, this method may deform or in the worst case destruct the substrate by heat generated during the forming process.

In the forming process, therefore, electron-emitting devices on the substrate are grouped into several blocks in units of row-direction wirings, column-direction wirings, or combinations of pluralities of row- and column-direction wirings. The forming voltage is switched and applied in units of blocks, thereby reducing the process time and suppressing a rise in temperature of the substrate by the heat generation.

However, in case the number of electron-emitting devices on the substrate becomes large for realizing a larger screen of the image display device, the substrate may be deformed or destructed in the worst case during the forming process. The present inventors have extensively studied to find that the cause of the above problem. This cause will be explained with reference to FIG. 20.

In FIG. 20, an electron source substrate 4101 is made of glass. Conductive films forming surface-conduction type electron-emitting devices (not shown) are connected in a matrix by row- and column-direction wirings 4102 and 4103. On the electron source substrate having this arrangement, surface-conduction type electron-emitting devices are grouped into first to M/bth blocks in units of b adjacent row-direction wirings, and the forming voltage is applied while sequentially switching the blocks.

According to this forming voltage application method, heat generated by a current (to be referred to as a forming current) flowing through the conductive film forming the surface-conduction type electron-emitting device concentrates in a block applied the forming voltage, thus causing a steep temperature gradient on the substrate. FIG. 20 is a graph showing an example of the temperature distribution (temperature gradient) on the substrate when the forming voltage is applied to block 1.

This steep temperature gradient on the substrate generates thermal stress to deform or destruct in the worst case the substrate.

If the number of surface-conduction type electron-emitting devices in one block is decreased and the number of blocks is increased, the temperature rise can be suppressed to prevent the deformation and destruction of the substrate. However, blocks must be frequently switched, which increases the time necessary for the forming process and the fabrication cost.

As another means for avoiding the temperature rise, as disclosed in Japanese Patent Application Laid-Open No. 7-176265, one of the x-direction wirings is selected to perform the forming process for conductive films connected to this wiring, and then another x-direction wiring is selected to perform the forming process. This operation is repeatedly executed to perform the forming process for all conductive films.

This method, however, prolongs the time spent for the forming process for all conductive films, and increases the fabrication cost in proportion to an increase in the number of x-direction wirings.

To the contrary, after one pulse of the pulse voltage is applied to one x-direction wiring, another x-direction wiring is selected to apply one pulse, and still another x-direction wiring is selected. After the pulse is applied to all x-direction wirings by repeatedly executing this operation, the pulse voltage is applied again to the first x-direction wiring. By employing this method, the forming process can be done for all conductive films. This voltage application method will be called a "scroll" method hereinafter. The scroll method is disclosed in Japanese Patent Application Laid-Open No. 9-298029.

In the scroll operation, the duty of the application pulse voltage, i.e., the (pulse width)/(pulse interval) ratio is equal to or lower than the reciprocal of the number of x-direction wirings when viewed from elements subjected to the forming process. In other words, as the number of x-direction wirings increases, the duty decreases inversely proportionally. For the same pulse peak value, a small duty greatly decreases the gap formation rate of the forming process, which loses the original advantage of a short process time. Further, another problem arises in the forming process performed in a reducing gas. That is, if the power amount of one pulse decreases, formation of the gap does not progress but only reduction progresses. Then, the current flowing through the wiring increases to cause a large voltage drop by the wiring resistance. Consequently, the voltage applied to the element may vary to greatly vary the characteristics of the electron-emitting devices. Moreover, no gap may be formed. To keep the power amount applied to the conductive film by one pulse at a certain degree or more, the voltage value of the pulse must be increased. In this case as well, the current value flowing through the wiring increases to cause a large influence of the voltage drop by the wiring resistance. Therefore, when the forming process is performed by the scroll method in a reducing-gas-containing atmosphere, the number of electron source wirings which can be fabricated is limited to a given degree. More specifically, when an electron source to be fabricated is large in size, the advantage of the forming process in a reducing gas cannot be fully exploited. The forming process not using any reducing gas is possible, but prolongs the process time, and requires another implementation for shortening the process time.

It is an object of the present invention to provide a fabrication method capable of performing the forming process within a short time for the electron emitting regions of electron-emitting devices of an electron source having many x-direction wirings.

According to the present invention, there is provided a method of fabricating an electron source constituted by a plurality of x-direction wirings arranged on a substrate, a plurality of y-direction wirings crossing the x-direction wirings, an insulating layer for electrically insulating the x- and y-direction wirings, and a plurality of conductive films each of which is electrically connected to the x- and y-direction wirings and has a gap, comprising the conductive film formation step of forming a plurality of conductive films to be connected to the pluralities of x- and y-direction wirings, the grouping step of assigning said x-direction wirings into a plurality of groups, and the energization forming step of sequentially performing, for all the groups, the step of simultaneously applying a voltage to all wirings assigned to the same group, thereby forming gaps in the plurality of conductive films, in the grouping step a plurality of wirings are assigned to each group so that between wirings constituting a group, wirings constituting other groups are exist.

This fabrication method can shorten the time necessary for the forming process with respect to many devices. At the same time, this method can suppress concentration of heat generated by the energization forming process at part of the substrate, and thus can make heat generated during the energization forming process almost uniform on the substrate. As a result, the substrate can be prevented from being deformed or cracked by local concentration of heat generated during the energization forming process.

According to the present invention, the energization forming step preferably carried out so that between wirings assigned to one group and wirings assigned to another group to which the voltage is applied subsequently to the former group, wirings assigned to other group are disposed.

With this way, positional concentration of heat generated during the forming process can be further suppressed.

Further, the voltage is preferably applied not to overlap successive application periods between groups.

Consequently, positional concentration of heat generated during the forming process can be suppressed.

The voltage is preferably applied to one group a plurality of the number of times at a predetermined interval.

Also, positional concentration of heat generated during the forming process can be suppressed.

The voltage is preferably applied to remaining groups during the interval of application of the voltage to one group.

The time necessary for the forming process can be further shorten.

DETAILED DESCRIPTION OF THE PREFERRED EMBODIMENTS

The present invention will be described in more detail below.

EXAMPLE 1

Figure 8:
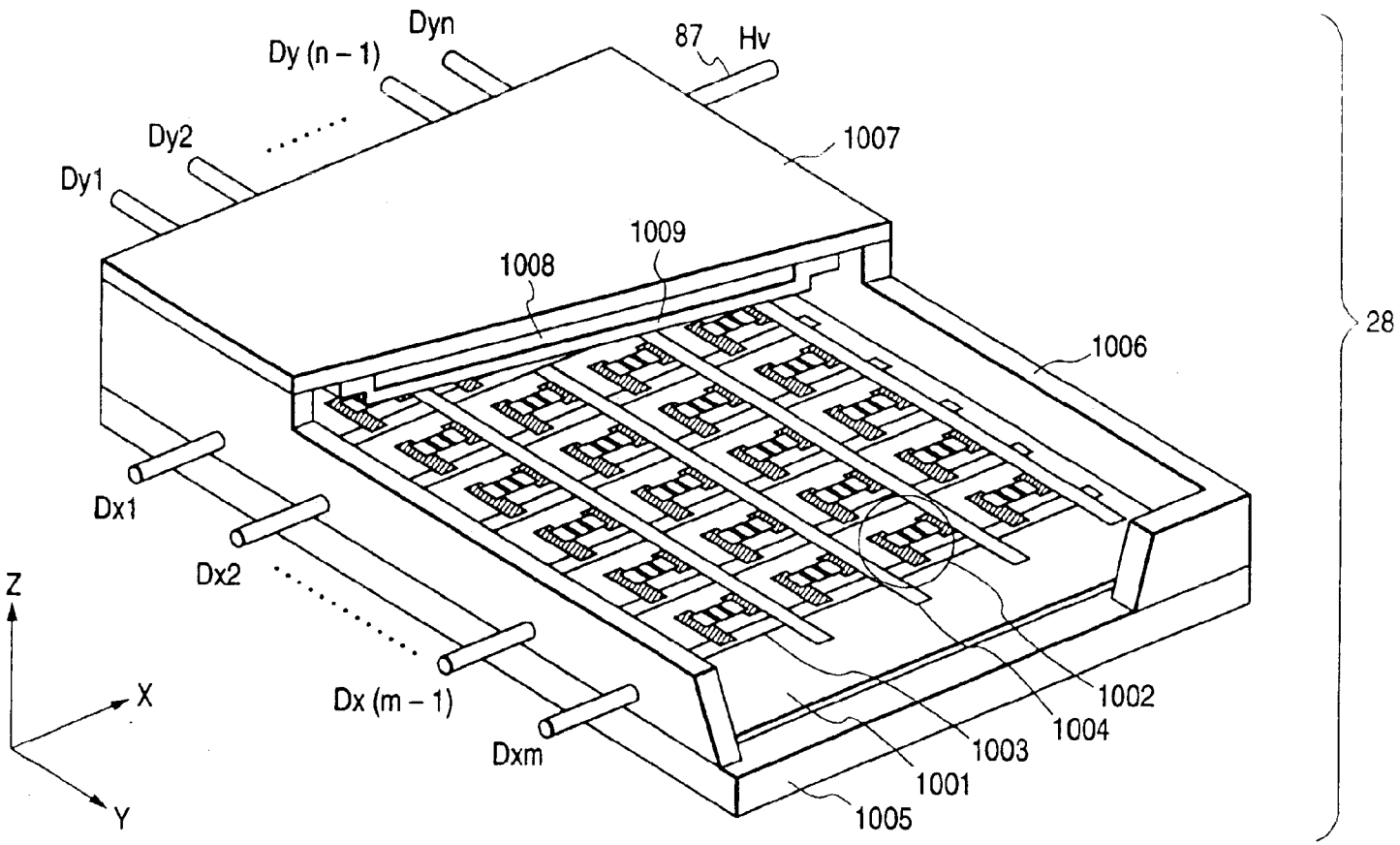
FIG. 8 is a perspective view for explaining the structure of the image forming apparatus.

FIG. 8 is a partially cutaway perspective view showing the internal structure of a display panel fabricated in Example 1.

In FIG. 8, a rear plate 1005, a support frame 1006, and a face plate 1007 form an airtight vessel (envelope) in order to keep the interior of the display panel vacuum. In assembling the vessel, joint portion of the respective parts must be sealed to obtain sufficient strength and maintain airtight condition. In Example 1, the vessel was assembled by applying frit glass to joint portions and sintering it at 450° C. for 10 min or more in air to seal (bond) the parts. A method of evacuating the vessel will be described later.

The rear plate 1005 has the substrate 1001 fixed thereon, on which n×m surface-conduction type electron-emitting devices 1002 are formed (n, m=positive integer equal to 2 or more, properly set in accordance with a desired number of display pixels. For example, in a display apparatus for high-resolution television display, preferably n=3,000 or more, m=100 or more. In Example 1, n=3,072, m=1,024). The n×m surface-conduction type electron-emitting devices are arranged in a simple matrix with m x-direction wirings 1003 and n y-direction wirings 1004. The portion constituted by the components 1001 to 1004 will be referred to as an electron source.

Figure 13:
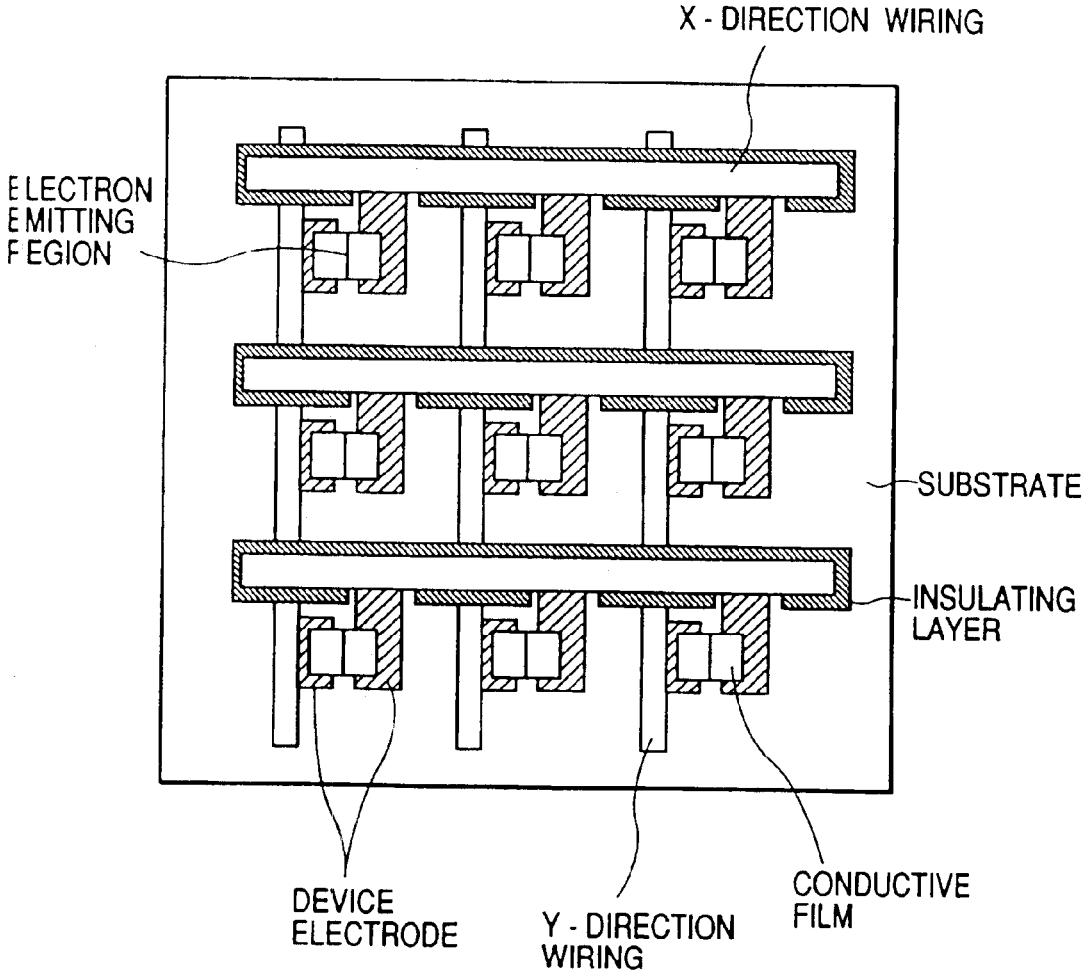
FIG. 13 is a partial plan view showing an electron source formed in the example.

FIG. 13 is a partial enlarged schematic plan view of the electron source. Surface-conduction type electron-emitting devices are arranged on the substrate in a simple matrix by the x- and y-direction wirings 1003 and 1004. At an intersection of the x- and y-direction wirings 1003 and 1004, an insulating layer (not shown) is formed between them to electrically insulate them.

In Example 1, the substrate 1001 of the electron source is fixed to the rear plate 1005 of the airtight vessel. If the substrate 1001 of the electron source has sufficient strength, the substrate 1001 of the electron source may also be used as the rear plate of the airtight vessel.

A fluorescent film 1008 is formed on the lower surface of the face plate 1007. Since Example 1 concerns a color display apparatus, the fluorescent film 1008 is coated with fluorescent substances of three, red, green, and blue primary colors.

Figure 14A:
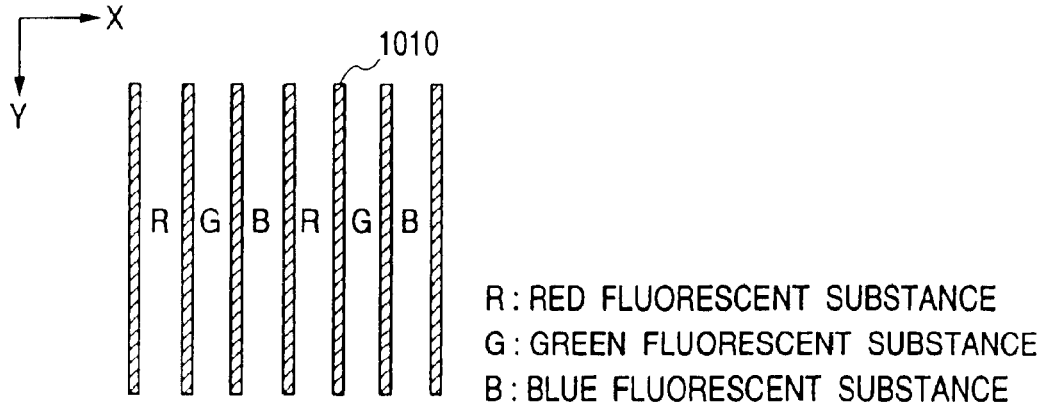
FIGS. 14A and 14B are plan views each showing the layout of the fluorescent substance.

In FIG. 14A, the fluorescent substances are formed into a striped shape, and black members 1010 are provided between the stripes of the fluorescent substances.

Arrangement of the fluorescent substances of three primary colors are not limited to the stripes as shown in FIG. 14A.

Figure 14B:
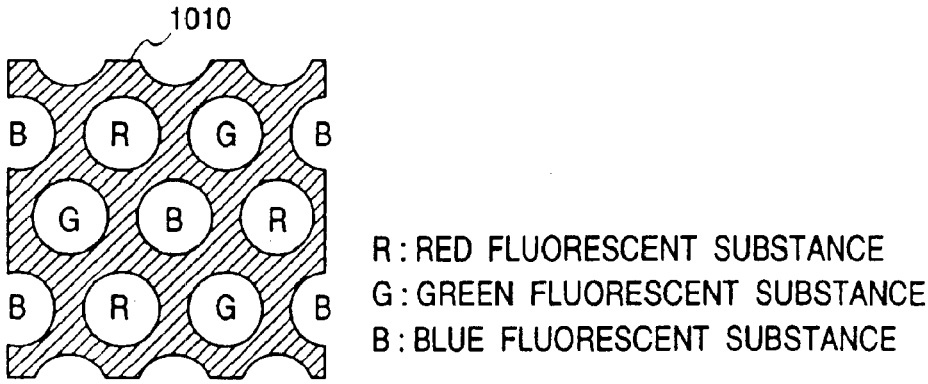

For example, the fluorescent substances may be formed into a delta layout as shown in FIG. 14B or another layout.

A metal back 1009 made of Al and well-known in the CRT field is formed on a surface of the fluorescent film 1008 facing the rear plate.

Electric connection terminals Dx1 to Dxm, Dy1 to Dyn, and Hv for the airtight structure electrically connect the display panel to an electric circuit (not shown). The terminals Dx1 to Dxm are electrically connected to the x-direction wirings 1003 of the electron source; Dy1 to Dyn, to the y-direction wirings 1004 of the electron source; and Hv, to the metal back 1009 of the face plate.

To evacuate the vessel, an evacuate tube attached to the vessel was connected to a vacuum pump (neither is shown) after assembling, and evacuated to a pressure of about $10^{-5}$ Pa. Thereafter, the evacuate tube was sealed to form the airtight vessel. To maintain the vacuum degree in the airtight vessel, a getter film (not shown) was formed at a predetermined position in the airtight vessel after sealing. The getter film was formed by heating and evaporating a getter material mainly containing Ba by RF heating.

The basic structure of the display panel according to Example 1 has been described.

Next, a method of fabricating the electron source used in the display panel according to Example 1 will be described.

Figure 15A:
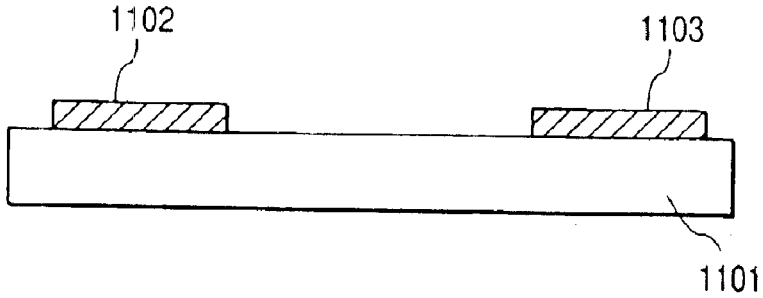
FIGS. 15A, 15B, 15C and 15D are schematic sectional views, respectively, showing the processes in forming an electron-emitting device in the example.

(1) As shown in FIG. 15A, device electrodes 1102 and 1103 were formed on a substrate 1101.

In formation, the substrate 1101 was fully cleaned with a detergent, pure water, and an organic solvent, and an device electrode material was deposited (the depositing method may be a vacuum deposition technique such as evaporation or sputtering). The deposited electrode material was patterned into a pair of device electrodes 1102 and 1103 shown in FIG. 15A by photolithography and etching.

Note that the device electrodes can be omitted as far as the conductive film comprising the surface-conduction type electron-emitting device can be directly and electrically connected to the x- and y-direction wirings (to be described later).

Examples of the substrate 1101 are various glass substrates such as quartz glass and soda-lime glass substrates, various ceramic substrates such as an alumina substrate, and substrates each prepared by stacking an $SiO_2$ insulating layer on each of the above substrates. Example 1 adopted a soda-lime glass substrate.

The device electrodes 1102 and 1103 formed parallel to the substrate 1101 to face each other were made of a conductive material. Examples of the conductive material are metals such as Ni, Cr, Au, Mo, W, Pt, Ti, Cu, Pd, and Ag, alloys of these metals, metal oxides such as $In_2O_3$ and $SnO_2$, and semiconductors such as polysilicon. The electrodes can be easily formed by a combination of a film-deposition technique such as vacuum evaporation and a patterning technique such as photolithography or etching, but may be formed by another method (e.g., printing technique). In Example 1, the device electrodes were made of Pt.

The shape of the device electrodes 1102 and 1103 is properly designed in accordance with an application purpose of the electron-emitting device. In general, an electrode interval L is designed by selecting an appropriate value within the range from several hundred Å to several hundred $\mu$m, and preferably within the range from several $\mu$m to several ten $\mu$m. An electrode thickness d is appropriately selected within the range from several hundred Å to several $\mu$m.

(2) 1,024 x-direction wirings 1003 and 3,072 y-direction wirings 1004 shown in FIGS. 8 and 13 were formed to be connected to the device electrodes. An insulating layer was formed at an intersection of the x- and y-direction wirings.

The wirings 1003 and 1004 and insulating layer were formed by photolithography. As the material for the wiring, Ag was used. As the material for the insulating layer, $SiO_2$ was used.

Figure 15B:
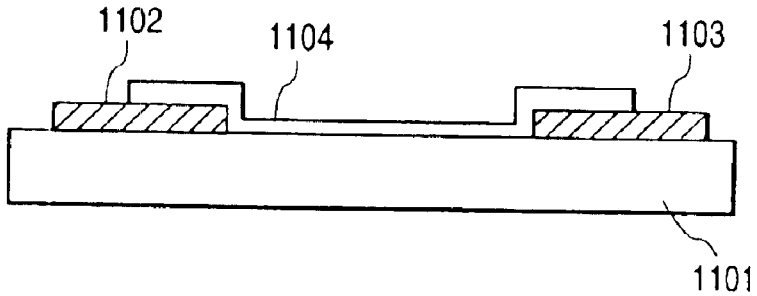

(3) As shown in FIG. 15B, a conductive thin film 1104 was formed between each pair of device electrodes 1102 and 1103.

In formation, solution of an organic metal compound was applied to the entire surface of the substrate in FIG. 15A, dried, and sintered to form a conductive film. The conductive film was patterned into a predetermined shape by photolithography and etching. The solution contains an organic metal compound of metallic element which is contained as a principal element in the conductive thin film. Example 1 used Pd as the metallic element. Example 1 employed dipping as an application method, but another method such as a spinner method or spraying may be employed.

The thickness of the conductive film is appropriately set in consideration of following conditions: condition necessary to electrically connect the conductive film to the device electrode 1102 or 1103, condition for the forming process (to be described later), condition for setting the electric resistance of the conductive film itself to an appropriate value, and the like. More specifically, the thickness is set within the range from several Å to several thousand Å, and preferably within the range from 10 Å to 500 Å.

Examples of the material used for forming the conductive film are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, and HfN, semiconductors such as Si and Ge, and carbons. The material is appropriately selected from them.

The sheet resistance of the conductive thin film 1104 is set to fall within the range from $10^3$ to $10^7$ Ω/□.

Since the conductive thin film 1104 and device electrodes 1102 and 1103 are desirably electrically connected, they partially overlap each other. In FIG. 15B, the conductive thin film 1104 and device electrodes 1102 and 1103 are stacked in the order of the substrate, device electrodes, and conductive thin film from the bottom, but may be stacked in the order of the substrate, conductive thin film, and device electrodes from the bottom.

By the above steps, an electron source before the forming process was formed.

Figure 15C:
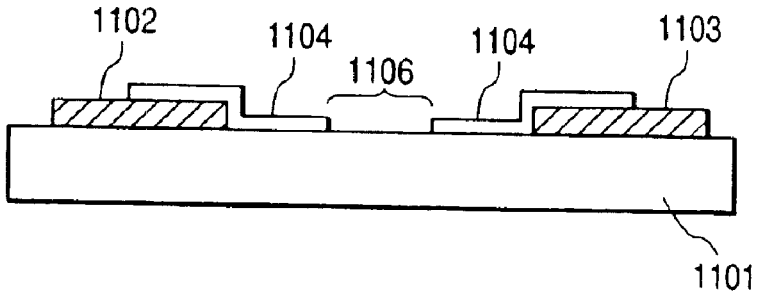

(4) As shown in FIG. 15C, an appropriate voltage was applied between the device electrodes 1102 and 1103 to perform the energization forming process, thereby forming a gap 1106 in each conductive film.

The energization forming method in Example 1 will be explained in detail below.

Figure 1:
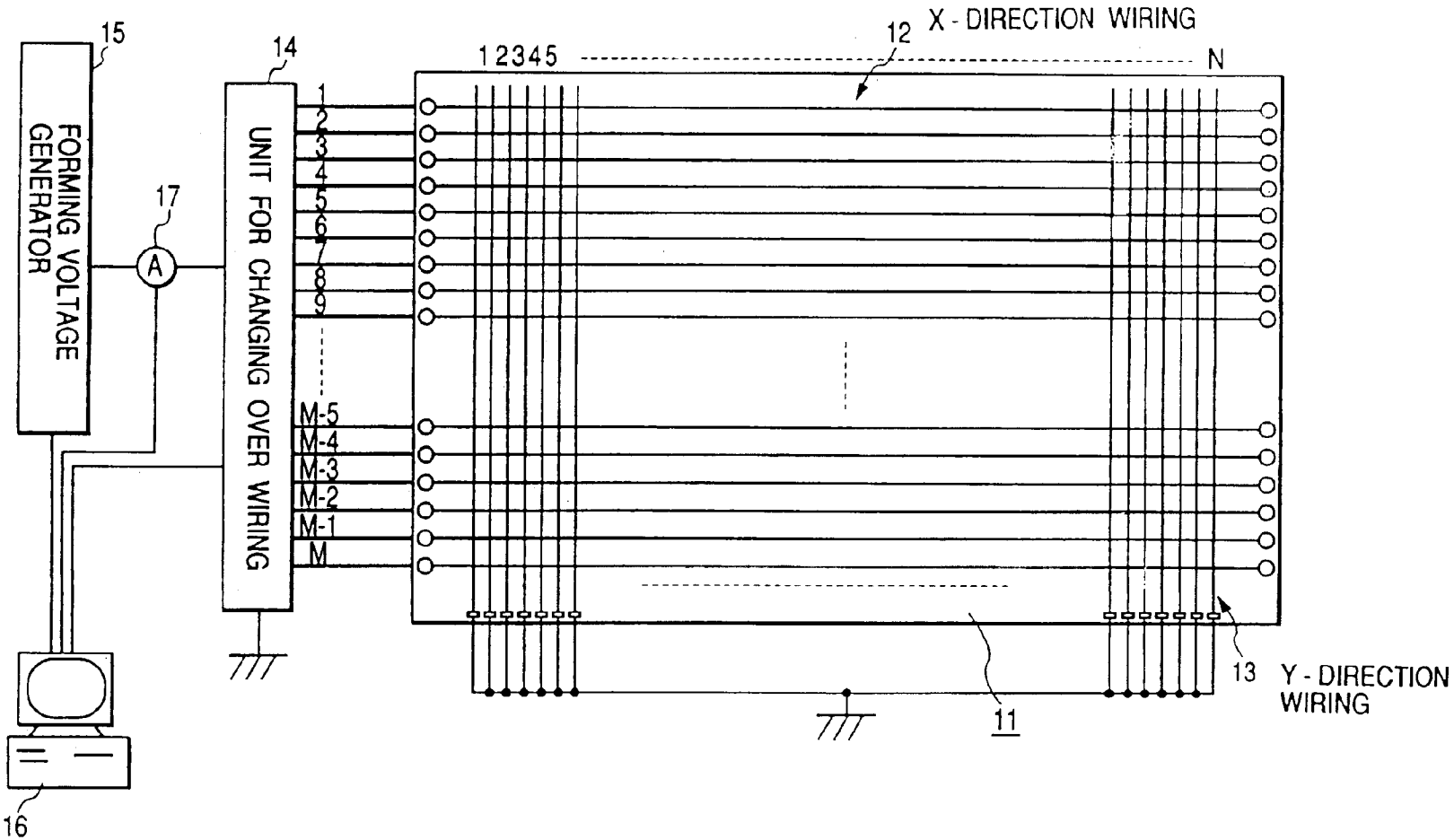
FIG. 1 is a block diagram showing an example of an apparatus for implementing the fabrication method of the present invention.

FIG. 1 is a conceptual view of an apparatus for performing the forming process. Y-direction wirings 13 (Dy1 to Dyn) are connected to common ground, and x-direction wirings 12 (Dx1 to Dxm) are connected to a unit 14 for changing over wiring. The unit 14 individually connects the x-direction wirings of an electron source 11 to a forming voltage generator 15 or ground via semiconductor devices or switching devices such as relays. The unit 14 can individually control switching of connection in units of x-direction wirings. An ammeter 17 can detect a current supplied from the forming voltage generator. Control of the unit and the forming voltage generator and data reception from the ammeter can be executed by a controller 16 such as a personal computer via a proper interface.

A method of applying the forming voltage in Example 1 will be explained. In Example 1, one group is constituted by 64 x-direction wirings.

More specifically, 1,024 x-direction wirings are assigned into 16 groups each constituted by 64 x-direction wirings. The forming voltage is applied in units of groups. Upon completion of the forming process for one group, the unit for changing over wiring is switched to perform the forming process for the next group. This operation is repeatedly executed to complete the forming process for all electron-emitting devices.

Figure 2:
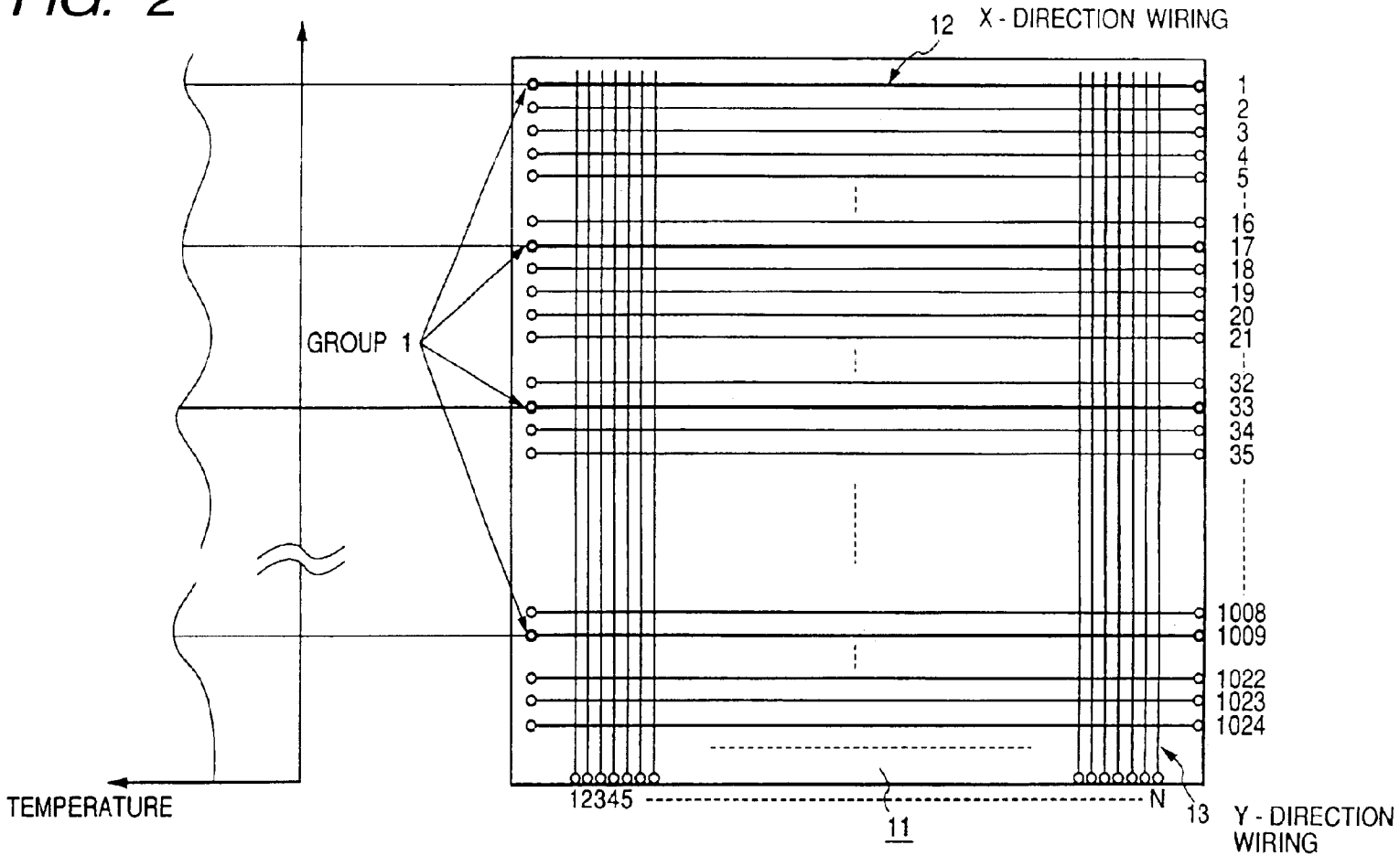
FIG. 2 is a diagram for explaining selection of the x-direction wiring and the temperature distribution of the substrate in the forming process according to the method of Example 1.

The x-direction wirings of each group are selected every 16 wirings. That is, the respective groups are set such that x-direction wirings Dx1, Dx17, Dx33, Dx49, . . . , Dx1010 belong to the first group, and x-direction wirings Dx2, Dx18, Dx34, Dx50, . . . , Dx1011 belong to the second group. This setting makes generation of Joule heat by the energization forming process almost uniform on the entire substrate. As a result, it can be prevented that the temperature of the substrate locally rises to adversely effect formation of the gap or damage the substrate by thermal stress or the like. FIG. 2 is a diagram showing the temperature distribution of the substrate when the forming voltage is applied to the first group. Note that the intervals between wirings belonging to each group are set strictly equal in Example 1, but may not be so strictly equal because the above effect can be attained so long as generation of Joule heat is made almost uniform.

Figure 3:
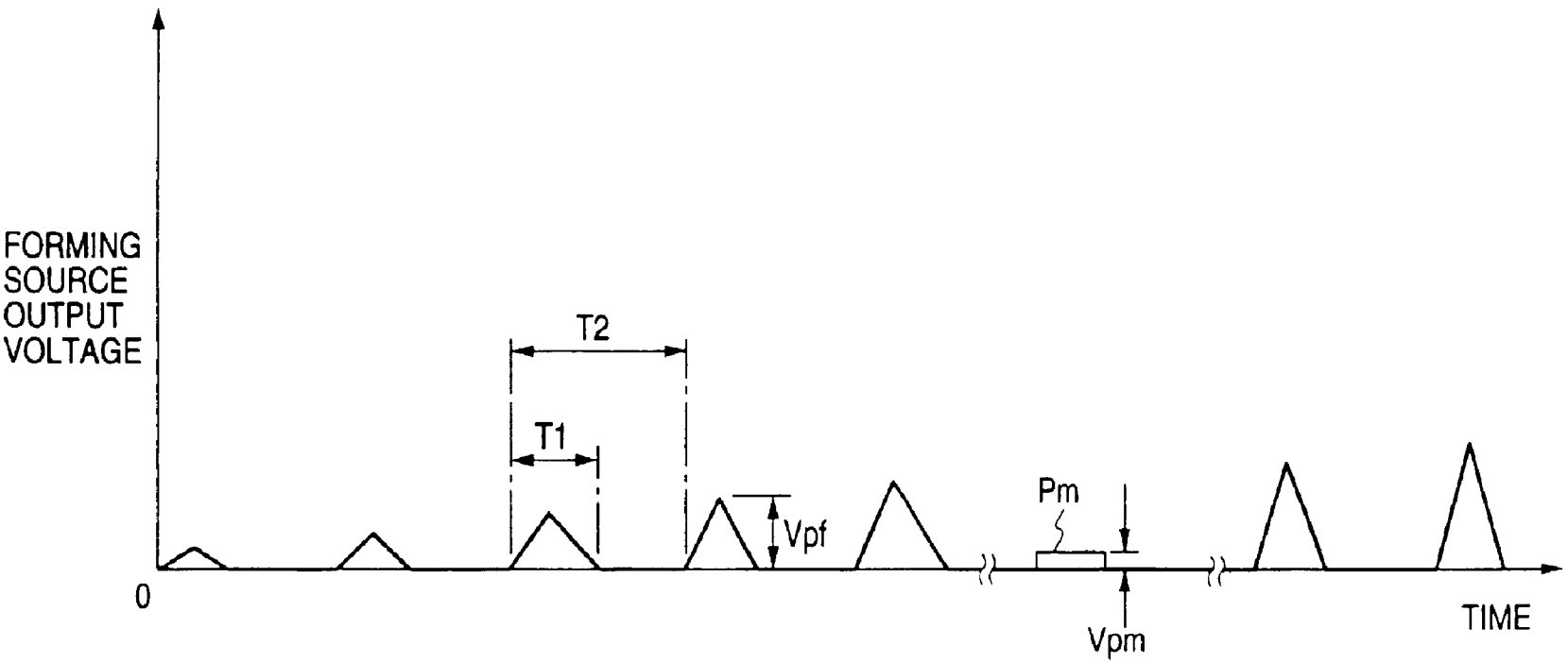
FIG. 3 is a graph for explaining the pulse voltage used in the forming process of Example 1.

FIG. 3 shows an example of the pulse waveform applied by the forming voltage generator. In FIG. 3, a triangular-wave pulse voltage having a pulse width T1 and a pulse interval T2 is applied while a pulse peak value Vpf is gradually increased. A rectangular-wave pulse having a peak value Pm is inserted to monitor a current flowing at that time and detect the progress of the forming process.

More specifically, an electron source is set in vacuum at a pressure of about $10^{-3}$ Pa, and the peak value Vpf is gradually increased for T1=1 msec and T2=10 msec. Every time five forming triangular-wave pulses are applied, the monitor rectangular-wave pulse Pm having a peak value of about 0.1 V is applied to detect a current by the ammeter and determine the completion of the forming process for each group. For example, when the resistance value per element exceeds 1 MΩ, the process for the group is completed and shifts to a next group by changing wirings to which the voltage is applied, by the unit for changing over wiring. This process was repeatedly executed to complete the forming process.

When the number of x-direction wirings is large, this method can greatly shorten the process time, compared to the case of performing the forming process in one by one manner about selection of x-direction wirings. Note that the number of x-direction wirings belonging to one group is 64 in Example 1, but can be appropriately selected depending on the design of the electron-emitting device and wiring.

Figure 4:
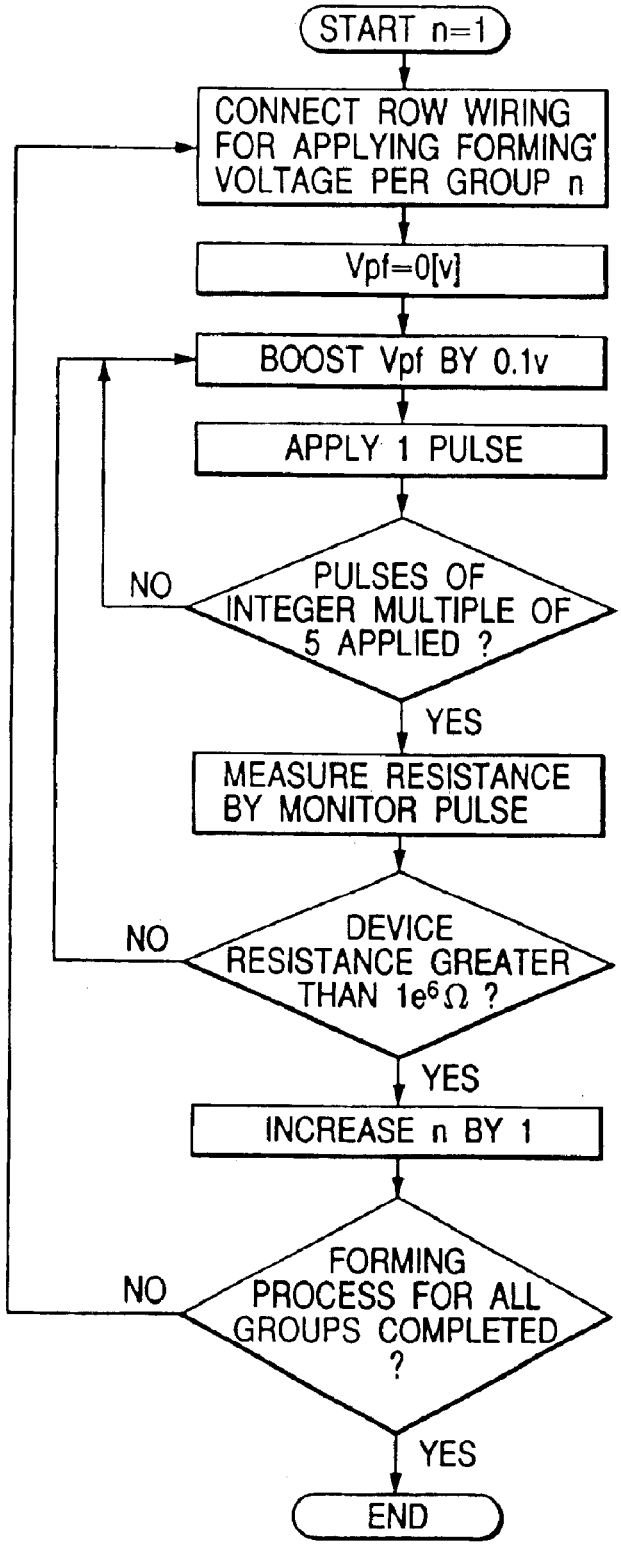
FIG. 4 is a flow chart for explaining the forming step of Example 1.

FIG. 4 is a flow chart showing the forming process in Example 1.

In Example 1, the forming process was done after the electron source before the forming process was sealed to form the vessel.

Figure 15D:
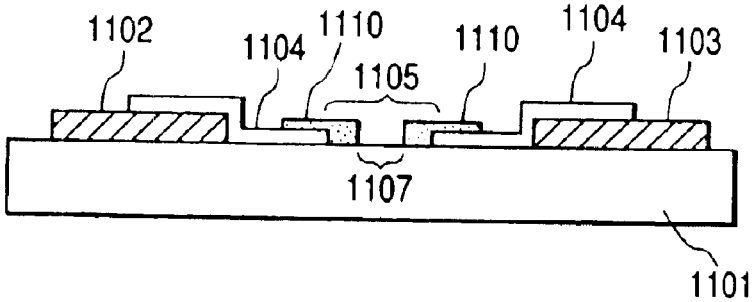

(5) As shown in FIG. 15D, an appropriate voltage was applied between the device electrodes 1102 and 1103 from a power source to perform the activation process.

More specifically, the vessel having undergone the forming process was kept the interior thereof within the pressure range between $1.3\times10^{-2}$ and $1.3\times10^{-3}$ Pa, and the voltage pulse was periodically applied to each conductive film to deposit a carbon film 1110 derived from an organic compound present in the atmosphere.

Figure 16A:
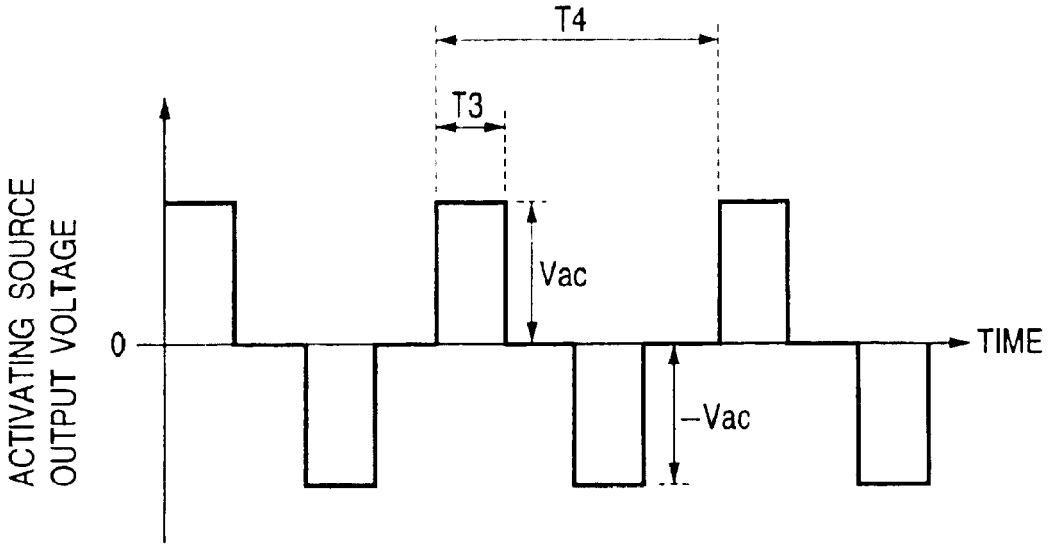
FIGS. 16A and 16B are graphs each showing the voltage waveform used in the activation step.
Figure 16B:
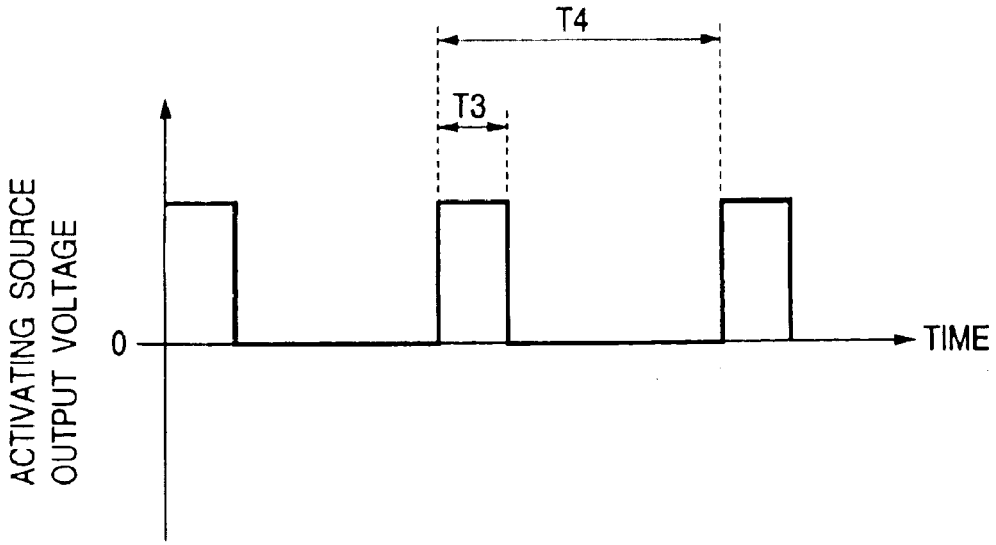

FIGS. 16A and 16B show examples of the appropriate voltage waveform applied from the power source for the activation process. In Example 1, a rectangular wave of a constant voltage having two polarities shown in FIG. 16A was periodically applied to perform the activation process. The rectangular wave had a voltage of ±14 V, a pulse width T3 of 1 msec, and a pulse interval T4 of 10 msec.

(6) The vessel was evacuated to about $10^{-6}$ Pa via the evacuation tube. In this evacuation, the vessel was heated. Then, the evacuation tube was sealed (chipped off) to form an airtight vessel.

The display apparatus in Example 1 fabricated by the above steps was driven to obtain a uniform high-brightness image.

EXAMPLE 2

In Example 2, the x-direction wirings of an electron source identical to that described in Example 1 are grouped similarly to Example 1, and the pulse voltage is applied to each group by the above-mentioned scroll method.

Figure 5:
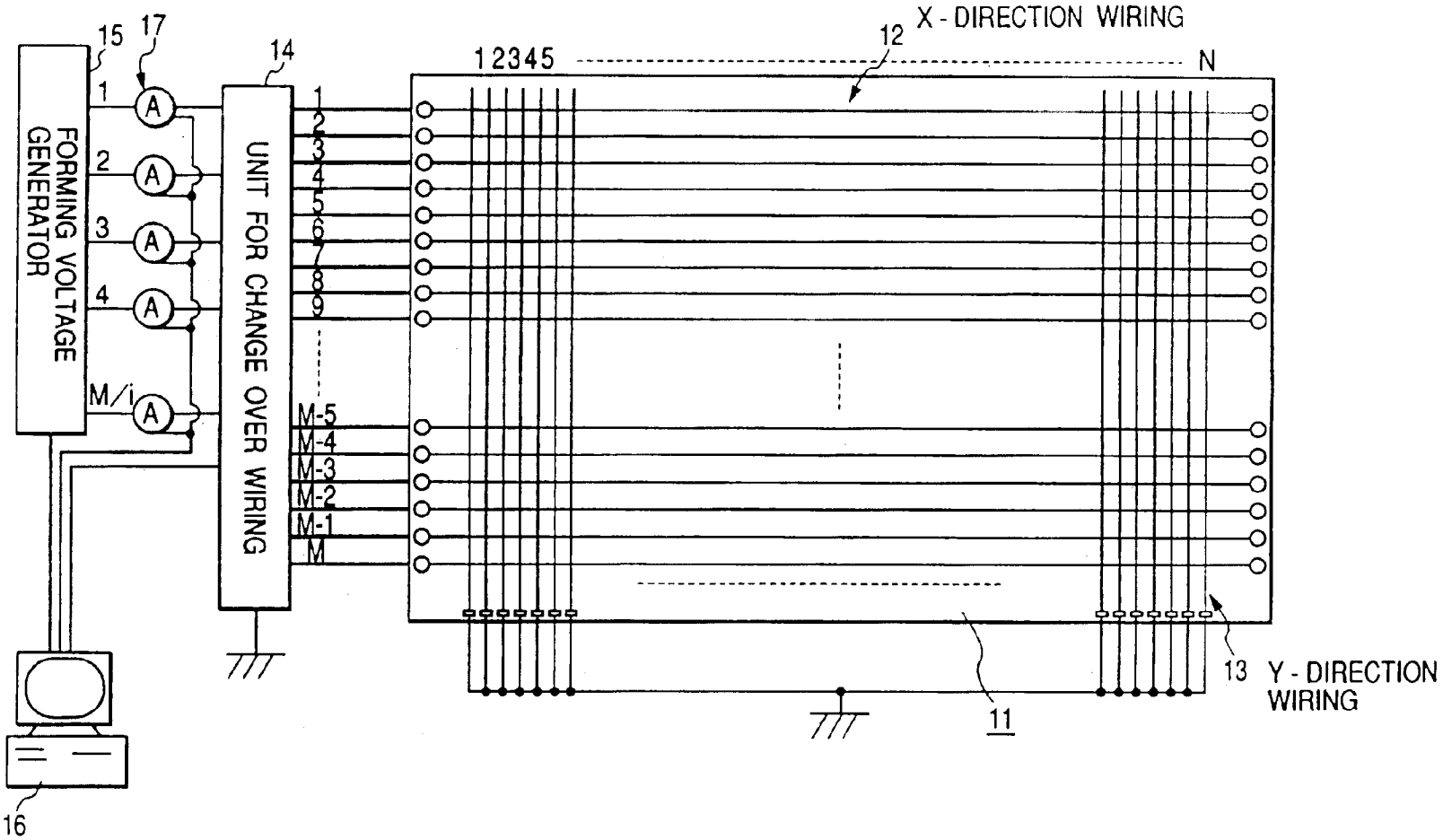
FIG. 5 is a block diagram showing another example of the apparatus for implementing the fabrication method of the present invention.

FIG. 5 is a block diagram showing an example of the arrangement of an apparatus used to perform the forming process in Example 2. In FIG. 5, numeral 12 denotes x-direction wirings and numeral 13 denotes y-direction wirings. A forming voltage generator 15 in this apparatus comprises 16 output terminals and can output pulses to them with a shift. A unit 14 for changing over wiring connects the output terminals of the forming voltage generator to wirings such that output terminal 1 is connected to x-direction wirings of group 1, output terminal 2 is connected to x-direction wirings of group 2, . . . , and output terminal 16 (=M/i) is connected to x-direction wirings of group 16. The following method can also be executed even by the same apparatus as in Example 1. In this case, however, the unit must have a very high switching speed. In the apparatus of Example 2, the forming voltage generator 15 must have a plurality of output terminals and the respective output terminals must function to sequentially output pulses, though the unit 14 need not operate at high speeds. The apparatus with this arrangement is suitable when the element of the unit 14 is a mechanical relay switch.

Figure 6:
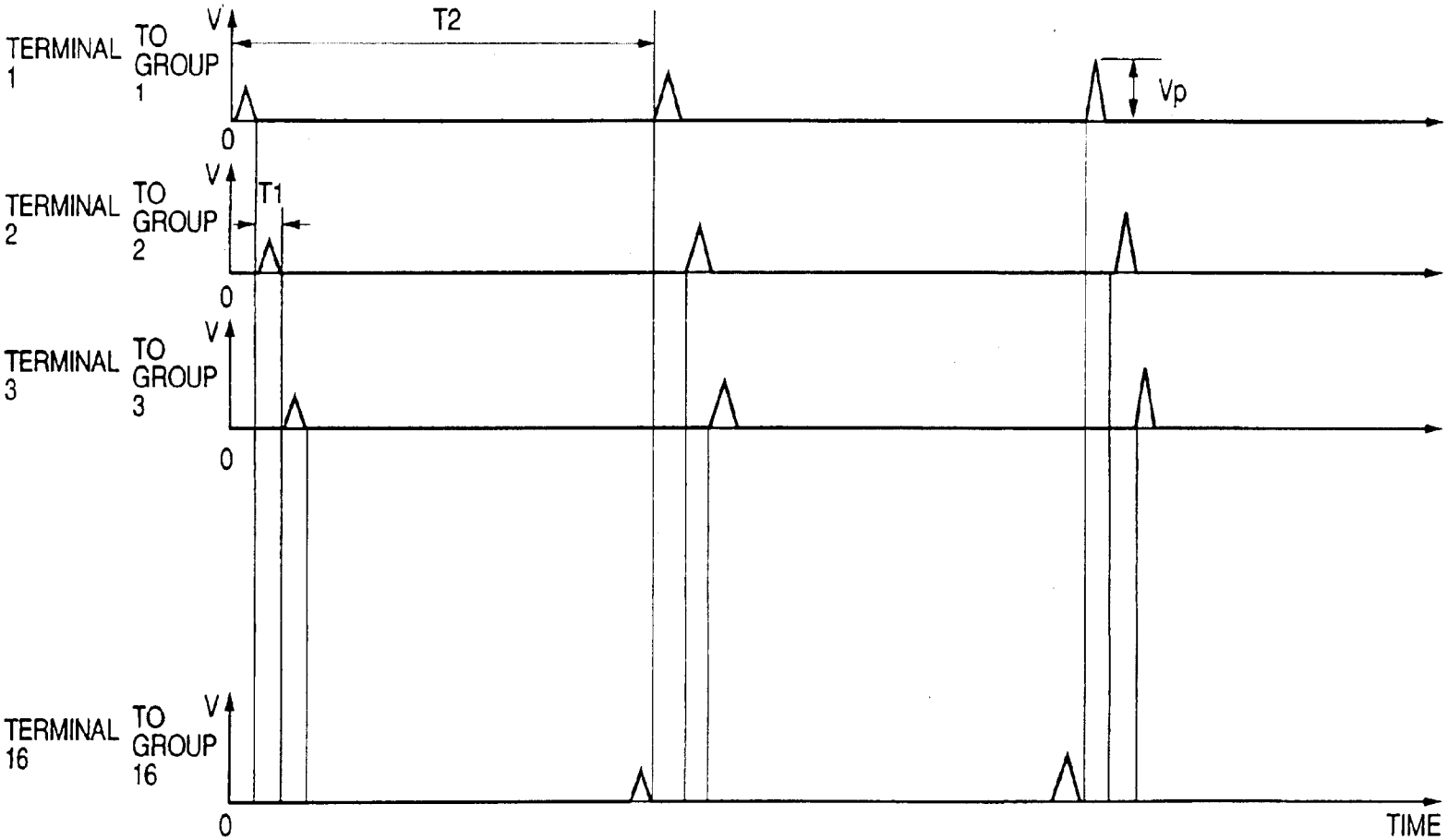
FIG. 6 is a timing chart for explaining the pulse voltage application method in the method of Example 2.

According to the grouping method in Example 2, 1,024 x-direction wirings are assigned into 16 groups each constituted by 64 x-direction wirings, as described in Example 1. A method of applying a pulse to each group will be explained with reference to FIG. 6. Every time one pulse is applied, the unit for changing over wiring switches a group to which a pulse generated by the forming voltage generator is applied. As shown in FIG. 6, after a pulse is applied to group 1, the unit switches the forming voltage generator to wirings of group 2 to apply one pulse. This operation is repeatedly executed to apply pulses up to group 16. After that, a pulse is repeatedly applied to group 1 again. FIG. 6 shows the case in which the pulse peak value Vp is gradually increased every sequence of application of the pulse voltage to respective groups. Letting N be the number of groups, the pulse width T1 and pulse interval T2 inevitably have a relation of $T1 \leqq T2/N$ for one group. When wirings are grouped in the above manner, $T1 \leqq T2/16$ holds. For T1=1 msec, $T2 \geqq 16$ msec holds.

In Example 2, x-direction wirings selected by successive groups (e.g., groups 1 and 2) are also selected at an interval. That is, x-direction wirings constituting a group to which the forming voltage is applied, and x-direction wirings constituting a group to which the forming voltage is applied next sandwich x-direction wirings constituting other groups. In Example 2, the pulse of the forming voltage is applied to successive groups at a short interval in order to shorten the time necessary for the forming process. Therefore, setting the interval between the x-direction wirings of successive groups is effective for making heat generated on the electron source substrate along with application of the forming voltage almost uniform.

Figure 17:
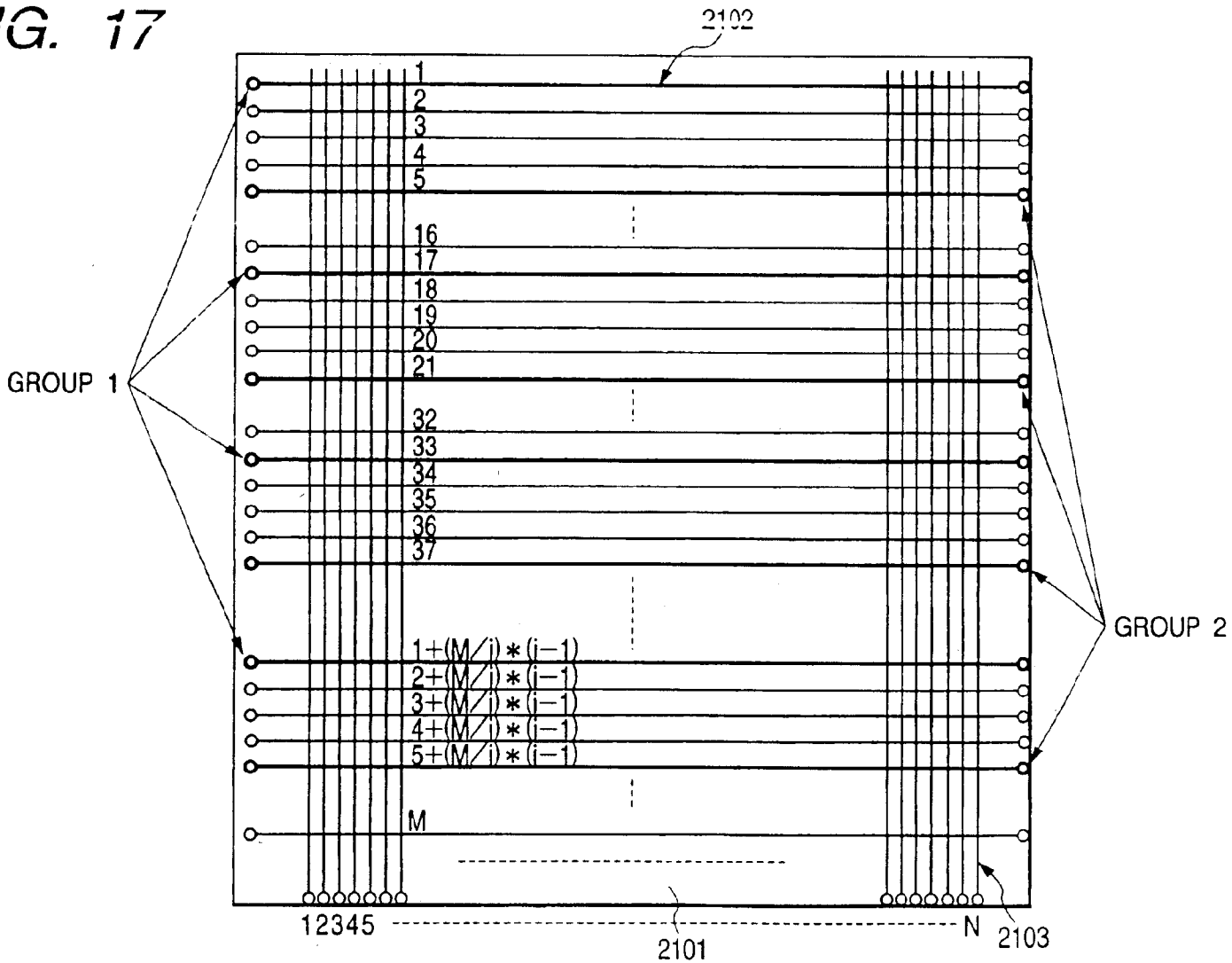
FIG. 17 is a diagram for explaining the x-direction wiring grouping method and the forming voltage application order in the example.

More specifically, as shown in FIG. 17, x-direction wirings 1, 17, 33, 49, . . . , 1+(m/i)*(i−1) are selected for group 1, x-direction wirings 5, 5+16, 5+32, . . . , 5+(m/i)*(i−1) are selected for group 2, and x-direction wirings a(k), a(k)+16, a(k)+32, . . . , a(k)+(m/i)*(i−1) are selected for group k. Note that m is the total number of x-direction wirings for use electron emission, e.g., 1,024 in Example 2, and i is the total number of groups, e.g., 16. In Example 2, the values a(k) are set to 1, 5, 13, 2, 6, 10, 14, 3, 7, 11, 15, 4, 8, 12, and 16 for k=1 to m/i. The value a(k) is not limited to this setting so far as heat generated on the electron source substrate can be made almost uniform.

Since the forming voltage is sequentially applied to respective groups, the heat generation amount on the electron source substrate per unit time increases. However, the substrate is considered to be destructed and deformed by concentration of heat on the substrate, rather than the absolute value of the heat generation amount. For this reason, destruction or deformation of the substrate can be prevented by adopting such a forming voltage application method as to make heat generated on the substrate almost uniform, like Example 2.

As described above, the forming process in Example 2 can shorten its process time in comparison with Example 1, and can more effectively prevent deformation or destruction of the electron source substrate along with application of the forming voltage.

EXAMPLE 3

In Example 3, the wiring, electrode, and conductive film were formed using printing and ink-jet method. The forming method in Example 3 is almost the same as in Example 2 except that the energization forming process was performed in a reducing atmosphere. X-direction wirings constituting two groups to which the voltage was successively applied sandwiched x-direction wirings of other groups.

The fabrication method of Example 3 will be briefly described with reference to FIGS. 8, 18A to 18C, and 19A to 19C. For illustrative convenience, FIGS. 18A to 18C and 19A to 19C show only nine electron-emitting devices, but in practice 480×2,442 elements were formed.

Step-1: Electrode Formation Step

Figure 18A:
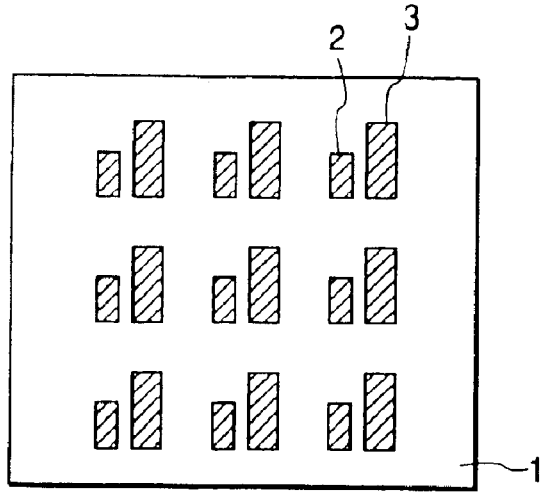
FIGS. 18A, 18B and 18C are partial plan views, respectively, showing the processes in forming an electron source in the example.

An $SO_2$ layer was formed on cleaned soda-lime glass by CVD to form a substrate 1. By offset printing using an ink containing an organic Pt compound, 480×2,442 pairs of Pt electrodes 2 and 3 were formed (FIG. 18A). The interval between each pair of electrodes was designed to 20 $\mu$m.

Step-2: Wiring Formation Step

Figure 18B:
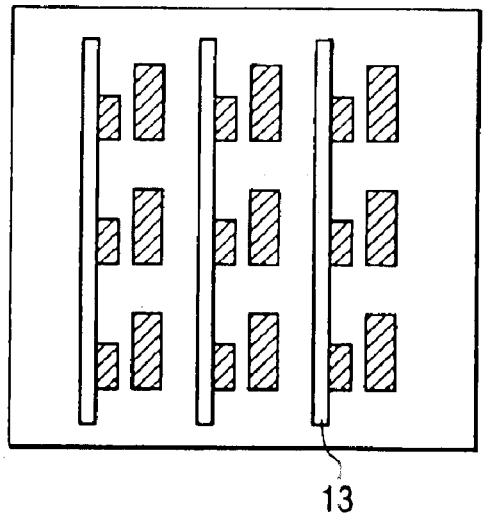
Figure 18C:
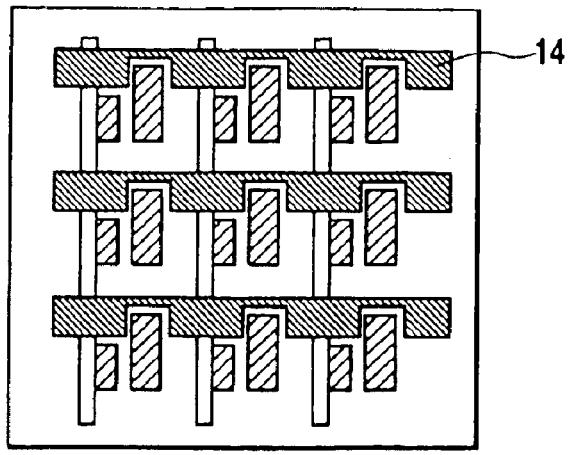
Figure 19A:
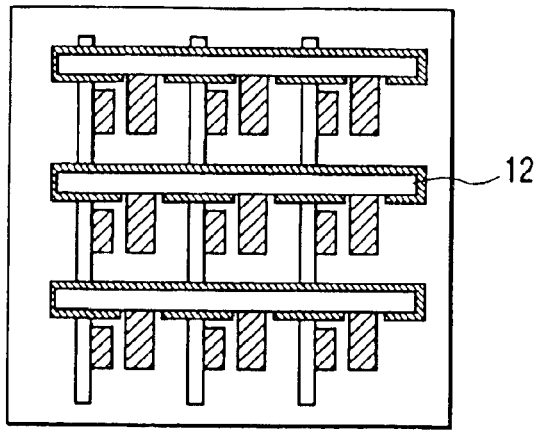
FIGS. 19A, 19B and 19C are partial plan views, respectively, showing the subsequent processes in forming an electron source in the example.

By screen printing using a paste containing Ag as a principal ingredient, 2,442 y-direction wirings 13 were formed (FIG. 18B). Then, insulating layers 14 were formed by screen printing using a glass paste (FIG. 18C). By the screen printing using the paste containing Ag as a principal ingredient, 480 x-direction wirings 12 were formed (FIG. 19A). In Example 3, 480 x-direction wirings and 2,442 y-direction wirings were formed.

Step-3: Hydrophobic Treatment Step

The substrate having the electrodes, wirings, and interlevel insulating layers was hydrophobically treated using a silane coupling agent.

Figure 19B:
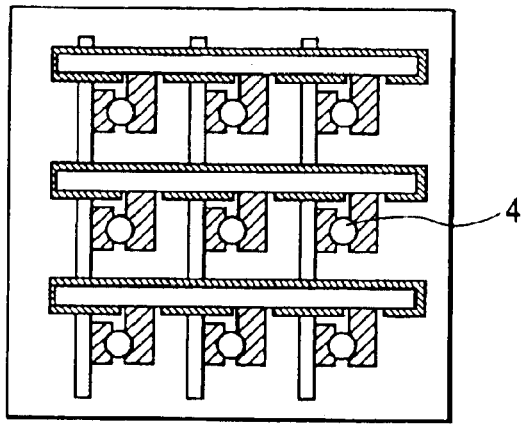

Step-4: Droplets of aqueous solution containing an organic Pd compound were applied over each pair of electrodes 2 and 3 by an ink-jet apparatus. The applied aqueous solution was dried to form a film of the organic Pd compound. The organic Pd compound film was baked at 350° C. to form a conductive film 4 mainly containing PdO (FIG. 19B).

By these steps, an electron source substrate before the forming process was formed.

Step-5: Face Plate Formation Step

A fluorescent film 1008 made of a fluorescent substance and black matrix was formed on a glass substrate 1007 by printing. An Al film was formed by vacuum evaporation to form a metal back 1009.

Step-6: Sealing (Bonding) Step

The electron source substrate before the forming process, the face plate, and a support frame were assembled as shown in FIG. 8, and frit glass applied at joint portions was heated, fused, and adhered to constitute an envelope 28. Example 3 used the electron source substrate as a rear plate.

Although not shown, the envelope 28 incorporated a spacer between the electron source substrate (rear plate) and face plate in order to keep the interval between them constant, and a getter in order to keep the internal pressure of the envelope low upon completing the image forming apparatus.

In addition, although not shown, an evacuation tube was attached to the envelope, in order to evacuate the envelope and to introduce a gas necessary in each step.

A high-voltage connection terminal 87 was connected to the metal back 1009 in the envelope 28. The metal back was connected to a high-voltage source in driving the image forming apparatus.

Step-7: Energization Forming Step

All external terminals Dy1, Dy2, . . . , Dy2442 of the y-direction wirings in FIG. 8 were connected to ground, and external terminals Dx1, Dx2, . . . , Dx480 of the x-direction wirings were connected to the corresponding output terminals of a driver.

The driver used in Example 3 comprises independent pulse generators corresponding to 480 x-direction wirings. The driver also has a control function capable of properly adjusting the timing of a pulse generated by each pulse generator.

In Example 3, 480 x-direction wirings were grouped such that one group was constituted by six wirings each selected every 80 x-direction wirings.

The total number of groups was 80.

As shown in FIG. 6, the pulse voltage was applied to each group by the above scroll method to perform the forming process.

That is, as shown in FIG. 6, Example 3 repeatedly executed the procedure of applying the pulse voltage to all the remaining groups during the pulse interval T2 of the pulse voltage applied to one group. Note that the pulse voltage was not simultaneously applied to respective groups. Although FIG. 6 shows a triangular pulse, the pulse shape in Example 3 was a rectangular wave.

In this scroll method, the order of applying the voltage to respective groups was set not to successively apply the voltage to groups constituted by adjacent x-direction wirings.

More specifically, the first pulse voltage was simultaneously applied to x-direction wirings (to be referred to as "group 1") each selected every 80 x-direction wirings from the first x-direction wiring. The second pulse voltage was simultaneously applied to x-direction wirings (group 41) each selected every 80 x-direction wirings from the 41st x-direction wiring.

Similarly, the voltage was applied such that x-direction wirings constituting a group to which the voltage was applied, and x-direction wirings constituting a group to which the voltage was applied next sandwiched x-direction wirings constituting another group.

Figure 19C:
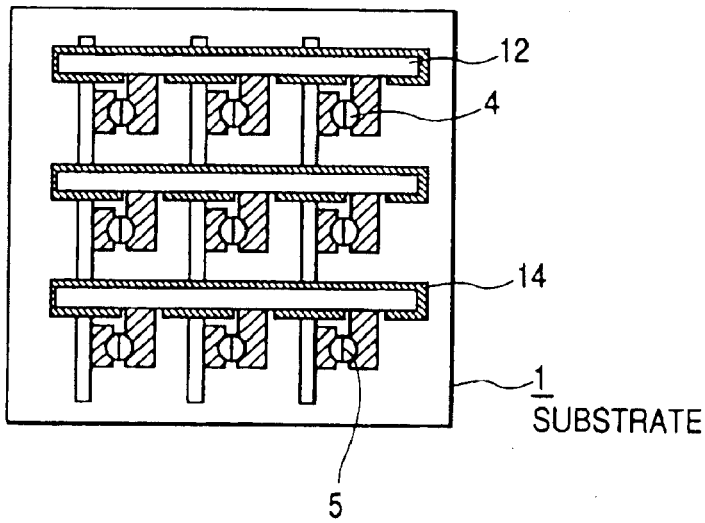
Figure 20:
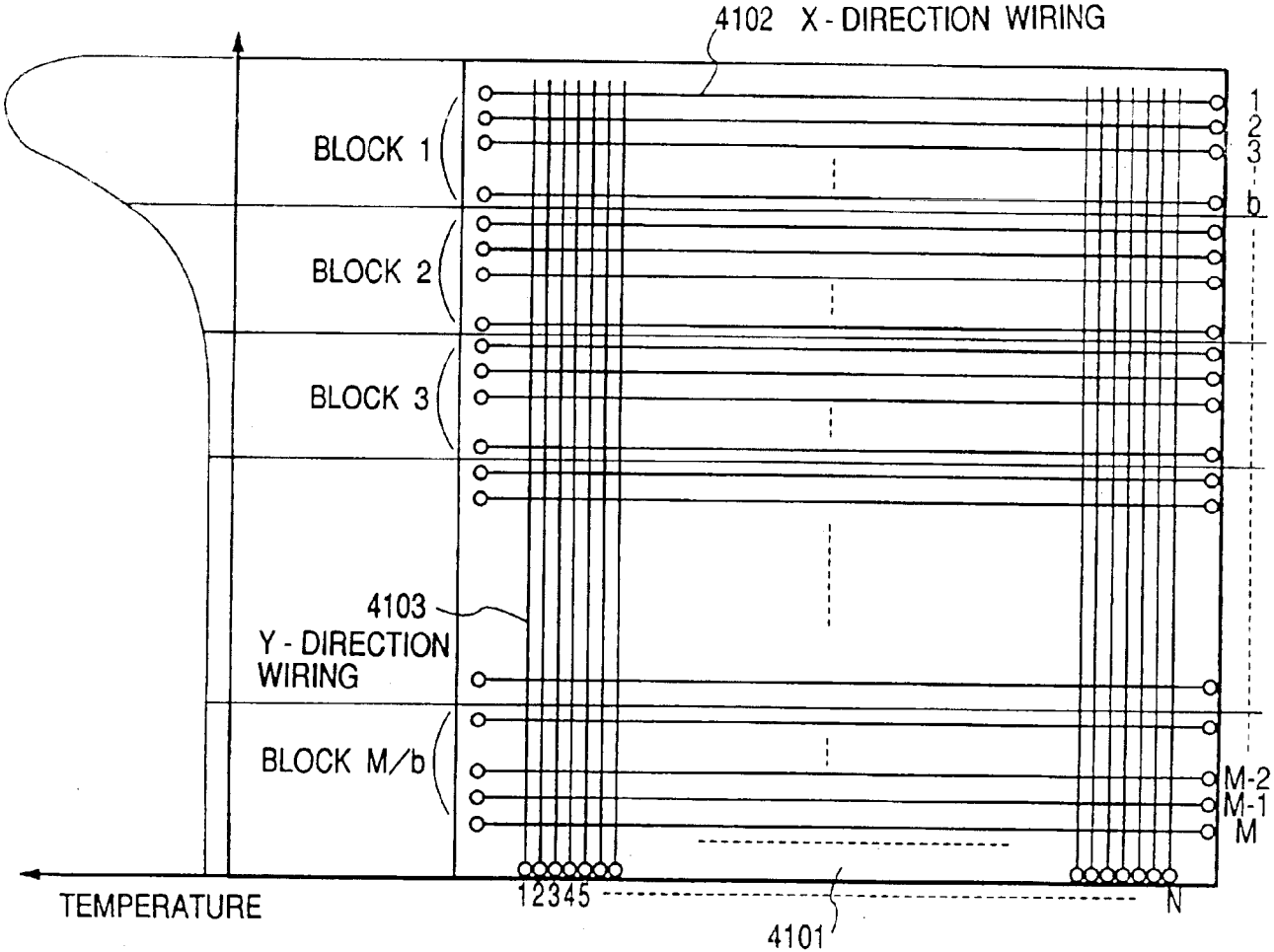
FIG. 20 is a diagram for explaining the problem.

After the pulse voltage was applied to all groups, the pulse voltage was repeatedly applied to respective groups as a result each electron emitting regions 5 were formed (FIG. 19C).

The forming step will be explained in detail.

The evacuation tube attached to the sealed envelope was connected to a vacuum equipment having vacuum pump (exhaust device) and a gas supply device and the like. While the whole envelope was held at 50° C., it was evacuated. When a pressure measured by a pressure gauge arranged near the connection portion of the vacuum equipment to the evacuation tube reached about $10^{-5}$ Pa, pulse application started by the scroll forming method.

The pulse applied at that time was a rectangular-wave pulse having a peak value of 10 V, a pulse width of 3 msec, and a pulse interval of 880 msec. The timing was controlled to apply the pulse with a shift of 11 msec to respective groups selected in the above way.

Immediately after a gas mixture of 98%-$N_2$ and 2%-$H_2$ was introduced into the equipment 5 sec after the start of pulse application, the forming process for all elements was completed.

Step-8: Energization Activation Step

After the forming step, the envelope was evacuated again.

Figure 7:
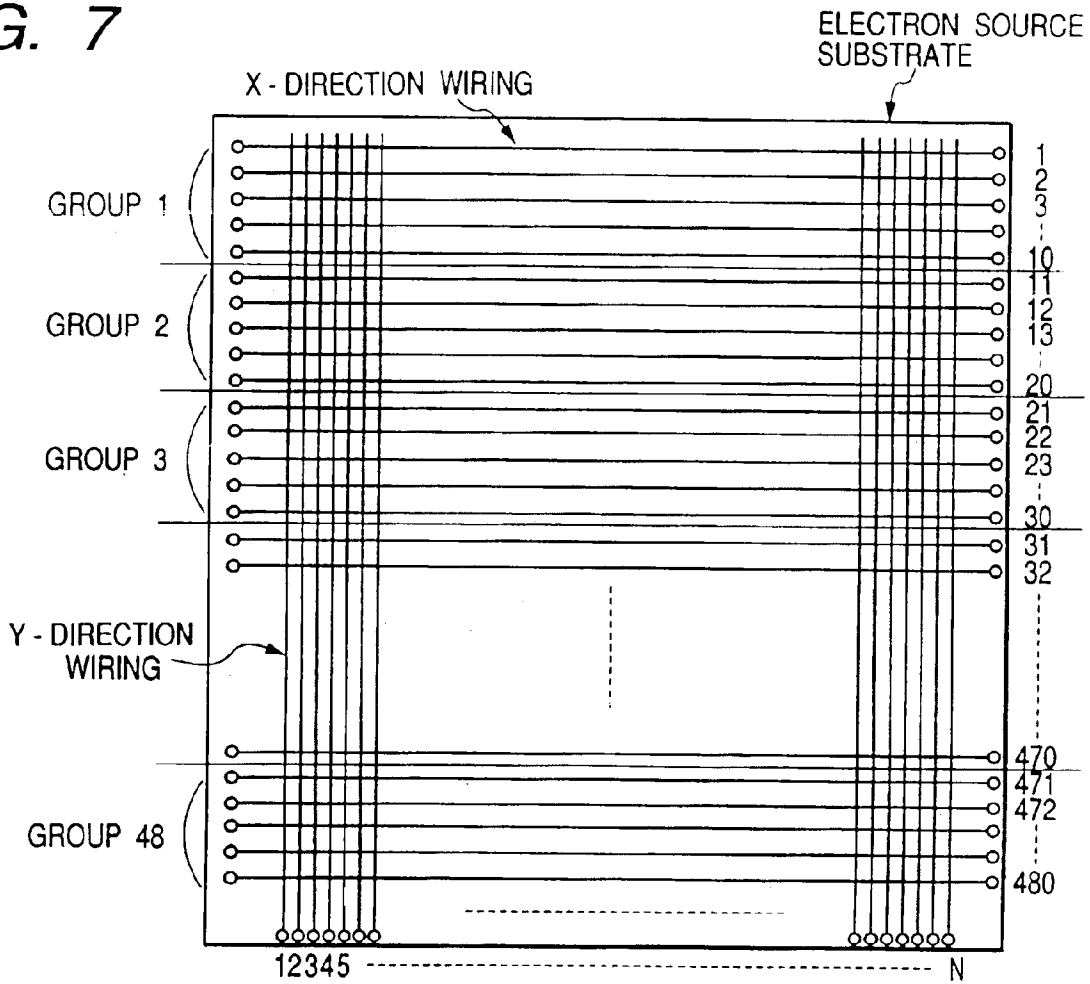
FIG. 7 is a diagram showing the x-direction wiring grouping method in the activation step of Example 3.

Then, benzonitrile was introduced into the envelope. The introducing rate was controlled to set the measurement value of the pressure by the pressure gauge near the evacuation tube of the envelope to about $1.3\times10^{-3}$ Pa. In this process, 480 x-direction wirings were divided into 48 groups each constituted by 10 successive x-direction wirings, as shown in FIG. 7.

In Example 3, the activation process was completed in units of groups.

In other words, after the activation process for the first group was completed, the activation process for the second group started. After the activation process for the second group was completed, the activation process for the third group started. By this procedure, the activation process for all the 48 groups was completed.

In the activation process within each group, the pulse voltage was applied to respective x-direction wirings by the scroll method.

That is, at an interval between application of the pulse to one x-direction wiring and application of a next pulse, the pulse was applied to all the remaining wirings. Note that the pulse was not simultaneously applied to respective x-direction wirings.

The activation process in Example 3 adopted a rectangular-wave pulse having a pulse width of 1 msec, a pulse interval of 10 msec, and a peak value of 14 V.

Step-9: Stabilization Step

After the activation step, the envelope was held at 200° C. for 10 hrs while being evacuated by the vacuum pump.

At that time, the pressure gauge of the vacuum equipment exhibited a value $1.3\times10^{-5}$ Pa.

Step-10: Sealing (Chipping Off) Step

The getter set in the envelope was RF-heated to perform the getter process, and the evacuation tube was heated and sealed.

The image forming apparatus thus formed was connected to an image display driving circuit. A voltage of 5 kV was applied to the metal back via the high-voltage connection terminal to display an image, thereby confirming that the apparatus could display a uniform high-quality image.

EXAMPLE 4

In Example 4, the envelope was sealed after the forming and activation steps. The remaining steps were the same as in Example 3.

A process of fabricating an electron source and image forming apparatus according to Example 4 will be described.

An electron source before the energization forming process was formed by step-1 to step-4 as in Example 3.

The electron source before the forming process was set in a vacuum chamber.

The vacuum chamber comprises connection terminals to be connected to the x- and y-direction wirings on a substrate (an object formed comprising the wirings, the electrodes and the like on the substrate is referred to as an "electron source" for convenience hereinafter), and the like, and can apply a voltage to respective wirings from outside the vacuum chamber. The vacuum chamber allows introducing a desired gas at the same time as evacuation by an evacuation device, thereby controlling the internal atmosphere.

The energization forming and energization activation processes were done by the same methods as step-7 and step-8 in Example 3.

An envelope was formed by a sealing step corresponding to step-6.

In the sealing step of Example 4, parts were assembled, heated, and adhered using frit glass in an inert gas, e.g., Ar gas, thereby forming the envelope.

Subsequently, the same stabilization step as step-9 in Example 3 and the same getter process as step-10 were done to seal the evacuation tube and form an airtight vessel.

The image forming apparatus fabricated by the method of Example 4 could display a uniform high-quality image, similar to the image forming apparatus fabricated in Example 3.

EXAMPLE 5

The structure and fabrication method of the display panel and the like in Example 5 were the same as in Example 1 except for the forming process.

In Example 5, one group was formed by selecting i units each made up of two adjacent x-direction wirings. In Example 5, x-direction wirings were divided into m/(2*i) (16) groups for i=32. Note that m is the total number of x-direction wirings, and m=1,024 in Example 5.

Figure 9:
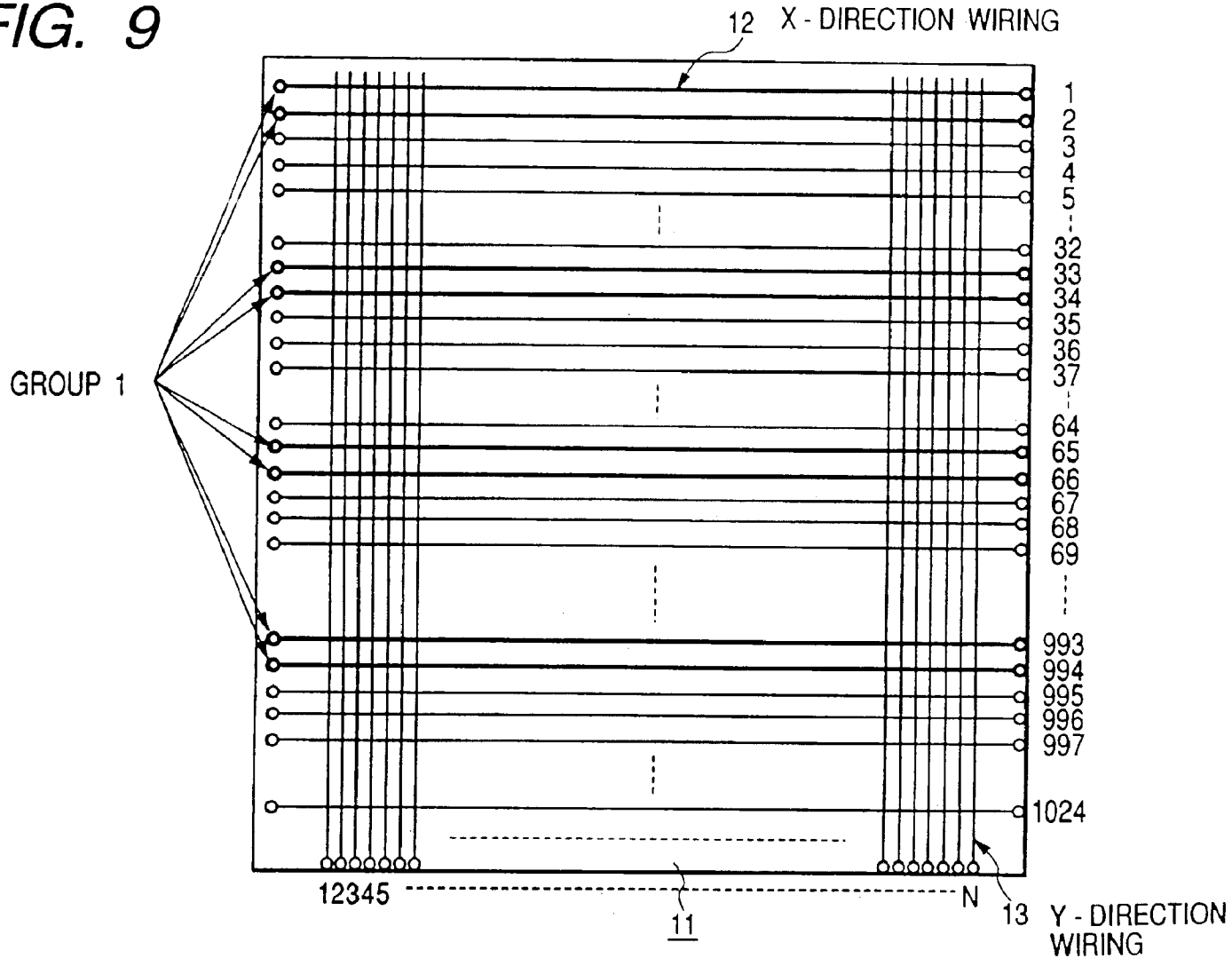
FIG. 9 is a diagram for explaining selection of the x-direction wiring in the method of Example 3.
Figure 10:
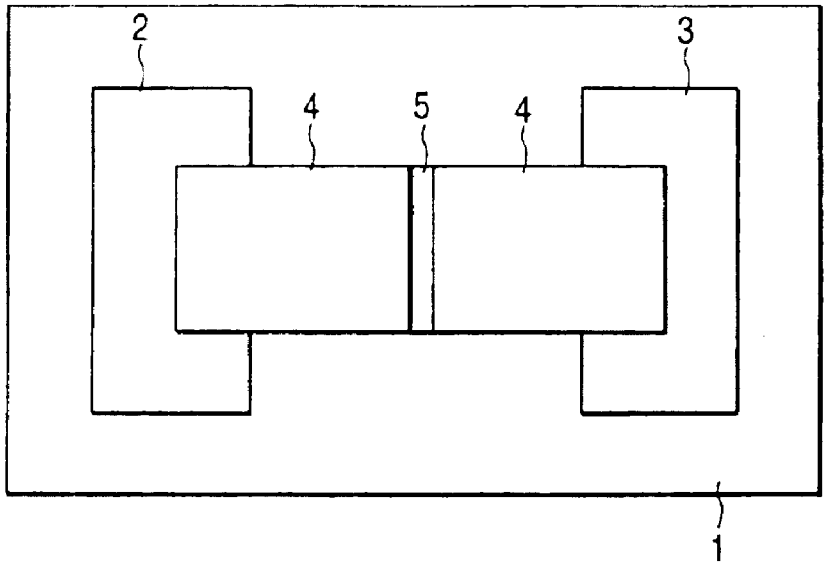
FIG. 10 PRIOR ART
FIG. 10 is a schematic plan view for explaining the structure of the surface-conduction type electron-emitting device.
Figure 11:
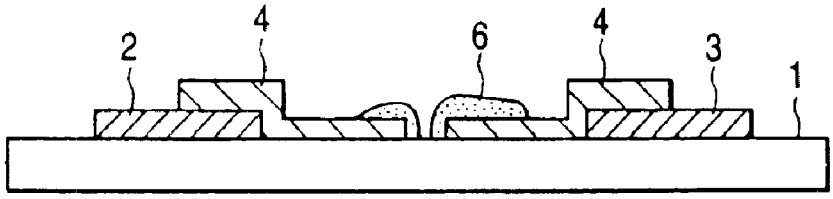
FIG. 11 PRIOR ART
FIG. 11 is a schematic sectional view for explaining the structure of the surface-conduction type electron-emitting device.
Figure 12:
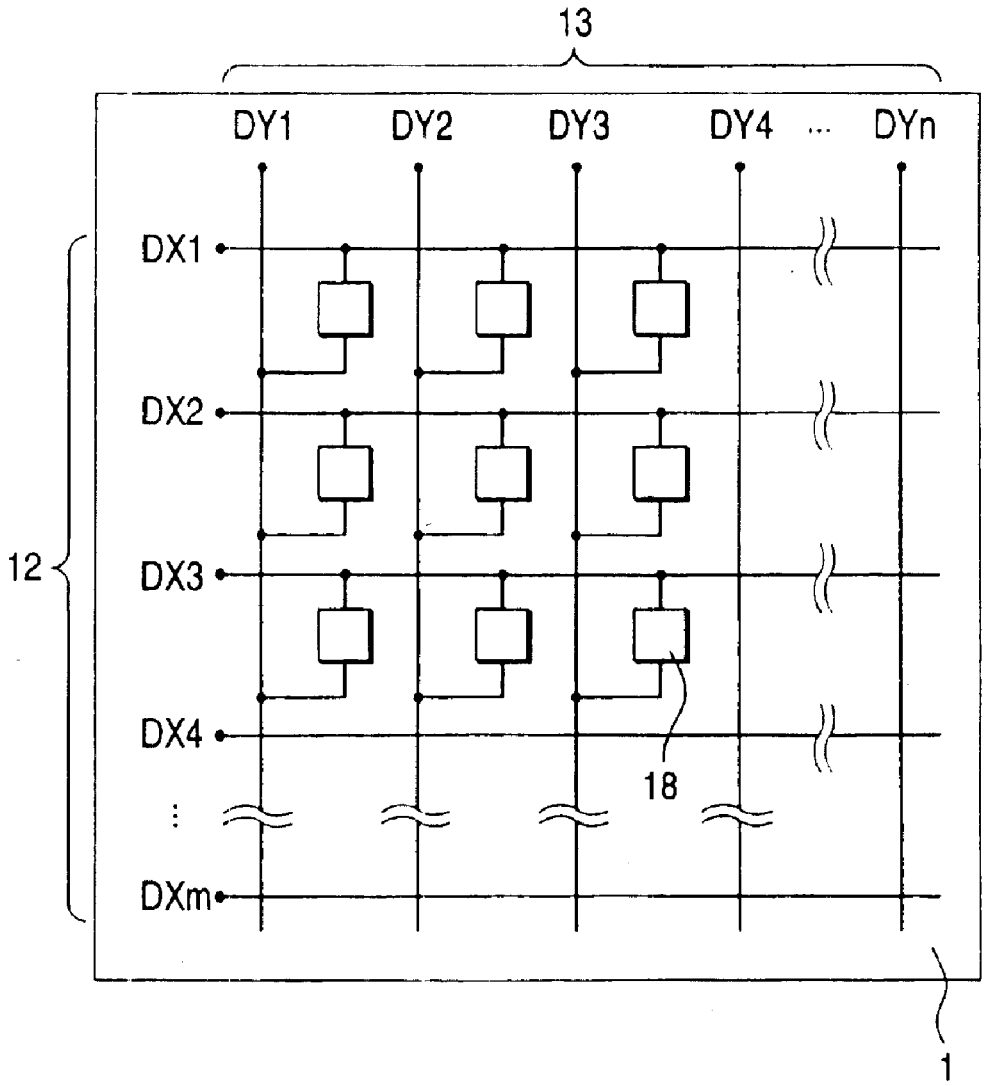
FIG. 12 PRIOR ART
FIG. 12 is a diagram for explaining the layout of the electron source.

Units constituting each group were selected at an equal interval of ((m/i)−2) (30 in Example 5) x-direction wirings. More specifically, as shown in FIG. 9, x-direction wirings 1, 2, 33, 34, . . . , 1+(m/i)*(i−1), and 2+(m/i)*(i−1) were selected for group 1, and x-direction wirings k, k+1, k+32, k+1+32, . . . , k+(m/i)*(i−1), and k+1+(m/i)*(i−1) were selected for group k.

Example 5 adopted the same apparatus and method used for the forming process as in Example 1.

Since the unit constituting the group was two adjacent x-direction wirings in Example 5, the temperature distribution on the substrate was less uniform than in Example 1. However, the uniformity of the substrate temperature was improved compared to the case in which all wirings belonging to the same group are successive.

EXAMPLE 6

Example 6 adopted another voltage application method when the groups of x-direction wirings were set similarly to Example 1. All x-direction wirings were divided into a plurality of groups almost equal in number, and the forming process was performed in units of groups by the conventional scroll method. That is, all x-direction wirings were divided into a plurality of groups each constituted by, e.g., 10 x-direction wirings. For example, group 1 was constituted by Dx1, DX103, Dx205, . . . , and group 2 was constituted by Dx2, Dx104, Dx206 . . . . Note that if the total number of x-direction wirings is not divided by 10, remaining wirings are properly assigned to any groups. An appropriate pulse voltage was applied to group 1 at the same time as the conventional scroll method. In other words, after one pulse was applied to Dx1, the unit for changing over wiring switched connection of the forming voltage generator to Dx103 to apply one pulse, and further switched connection to Dx205. When pulses were applied one by one to all the wirings of group 1, the unit switched connection to Dx1 again to repeatedly execute the same step. If the forming process was completed for the wirings of group 1 by repeatedly applying the pulse, the same process was performed for group 2. This operation was repeatedly executed to complete the forming process for all electron-emitting devices. When this method is employed, the duty of the forming pulse is limited by the reciprocal of the number of wirings belonging to one group. For example, to obtain a duty of 10%, the number of wirings belonging to one group must be set within 10. The number of groups therefore increases to prolong the time necessary for the forming process. However, a current flowing through the y-direction wiring is only a current flowing from one x-direction wiring, so that the influence of the resistance of the y-direction wiring can be minimized.

EXAMPLE 7

Example 7 is directed to a method of fabricating an electron source obtained by forming a wiring, electrode, and conductive film by printing and ink-jet method and performing the above forming process, and an image forming apparatus including the electron source. This fabrication method will be briefly explained with reference to FIGS. 8, 18A to 18C, and 19A to 19C.

Step-1: An $SiO_2$ layer about 80 nm thick was formed on cleaned soda-lime glass by CVD to form a substrate 1. By offset printing using an ink containing an organic Pt compound, Pt electrodes 2 and 3 were formed (FIG. 18A). The interval between electrodes was designed to 20 $\mu$m.

Step-2: Y-direction wirings 13 were formed by screen printing using a paste mainly containing Ag, and interlayer insulating layers 14 were formed using a glass paste (FIGS. 18B and 18C). X-direction wirings 12 were formed by the same formation method as the y-direction wirings (FIG. 19A). In Example 7, 240 x-direction wirings and 720 y-direction wirings were formed.

Step-3: The substrate having the electrodes, wirings, and interlevel insulating layers was hydrophobically treated using a silane coupling agent.

Step-4: Droplets of an aqueous solution containing an organic Pd compound were applied over the electrodes 2 and 3 of each electron-emitting device by an ink-jet apparatus. The applied drop was dried to form a film of the organic Pd compound. The organic Pd film was annealed at 350° C. to form a conductive film 4 mainly containing PdO (FIG. 19B).

Step-5: A face plate 1007 was prepared by forming a fluorescent film 1008 made of a fluorescent substance and black matrix on a glass substrate by printing and forming an Al film by vacuum evaporation.

Step-6: The substrate having the electron source was used as a rear plate. The rear plate, the face plate, and a support frame were assembled as shown in FIG. 8, and adhered to each other with frit glass, thereby constituting an envelope 28. Although not shown, the envelope 28 incorporated a spacer between the electron source substrate (rear plate) and face plate in order to keep the interval between them constant, and a getter in order to maintain the internal pressure of the envelope upon completing the image forming apparatus. In addition, although not shown, an evacuation tube was attached to the envelope in order to evacuate the envelope and to introduce gas necessary in each step. A high-voltage connection terminal 87 was connected to the metal back 1009 in the envelope 28. The high-voltage connection terminal 87 was connected to a high-voltage source in order to apply a high voltage for accelerating electrons toward the metal back 1009 in driving the image forming apparatus.

Step-7: This step is the forming process step as a feature of the present invention. All external terminals Dy1, Dy2, . . . , Dyn of the y-direction wirings in FIG. 8 were connected to ground, and external terminals Dx1, Dx2, . . . , Dxm of the x-direction wirings were connected to the unit for changing over wiring in FIG. 1. In Example 7, three successive x-direction wirings constituted one group such that the first to third x-direction wirings constituted group 1; the fourth to sixth wirings constituted group 2, . . . , the 238th to 240th wirings constituted group 80. Example 7 adopted a method of applying the pulse voltage by the scroll method, similar to Example 2.

The evacuation tube attached to the envelope was connected to a vacuum equipment having an exhaust device (vacuum pump) and a gas supply device and the like. While the whole envelope was held at 50° C., it was evacuated. When a pressure measured by a pressure gauge arranged near the connection portion of the vacuum equipment to the evacuation tube reached about $10^{-5}$ Pa, pulse application started by the scroll forming method. The pulse applied at that time was a rectangular-wave pulse having a peak value of 10 V, a pulse width of 3 msec, and a pulse interval of 11 msec. A group to be selected was changed by the unit for changing over wiring every 11 msec equal to this pulse interval, and pulses were applied one by one to all the groups within 80 msec. In other words, each x-direction wiring received a pulse having a pulse width of 3 msec and a pulse interval of 880 msec.

Immediately after a gas mixture of 98%-$N_2$ and 2%-$H_2$ was introduced into the envelope 5 sec after the start of pulse application, the forming process for all elements was completed.

Note that a pulse having the same pulse width and interval as the above pulse was applied to an envelope fabricated similarly by the same scroll method, thereby performing the forming process. From these results, to satisfactorily perform the forming process, (1) when the temperature of the envelope was set to room temperature (about 20° C.) and no gas mixture of 98%-$N_2$ and 2%-$H_2$ was introduced, the pulse peak value had to be set to about 20 V. (2) When a gas mixture of 98%-$N_2$ and 2%-$H_2$ was introduced and the temperature of the envelope is set to room temperature, the pulse peak value had to be set to about 14 V. This is considered to be a decrease associated with the reduction speed of the conductive film. However, a preferable temperature at which the envelope is held changes depending on the material of the conductive film, the shape of a fine particle forming it, the type and pressure of reducing gas, and the like. It is therefore desirable to perform the forming process while the envelope is held at a proper temperature in accordance with the situation.

After the forming step, the envelope was evacuated again.

Step-8: The activation process was done. Benzonitrile was introduced into the envelope. The introducing rate was controlled to set the measurement value of the pressure by the pressure gauge near the portion for connecting to the evacuation tube of the vacuum equipment to about $1.3\times10^{-3}$ Pa. In this state, the pulse for the activation process was applied by a method of sequentially scrolling the x-direction wirings one by one. This pulse was a rectangular-wave pulse having a pulse width of 3 msec and a peak value of 14 V.

Step-9: After the activation step, the stabilization step was done. The envelope was held at 200° C. for 10 hrs while being evacuated by the vacuum pump. At that time, the pressure gauge of the vacuum equipment exhibited a value $1.3\times10^{-5}$ Pa.

Step-10: The getter set in the envelope was RF-heated to perform the getter process, and the evacuation tube was heated and sealed.

The image forming apparatus thus formed was connected to an image display driving circuit. A voltage of 5 kV was applied to the metal back via the high-voltage connection terminal to display an image, thereby confirming that the apparatus could display a uniform high-quality image.

EXAMPLE 8

Example 8 employed the same procedure as in Example 7 except for the following step.

An electron source formed by the method of Example 8 was larger in size than that formed in Example 7, and had 480 x-direction wirings and 2,442 y-direction wirings.

According to the scroll method in the forming process, one group was set by selecting six wirings each selected every 80 x-direction wirings, which is different from Example 7. The voltage was applied to each group by the same method as in Example 7. This is because the number of wirings selected simultaneously is twice the number of wirings in Example 7; and if the voltage is simultaneously applied to six successive wirings, the temperature may greatly rise to exert any adverse effect. In practice, an experimental electron source smaller in size than that in Example 8 was preliminarily examined by processing six successive wirings as one group to find that the emission characteristics (electron emission amount) of electron-emitting devices connected to some wirings tended to slightly decrease.

From these results, when the number of wirings selected simultaneously is large, setting successive wirings to the same group causes a large influence of the temperature rise, and thus the group is preferably set by wirings selected skippingly. The number of wirings at which this trend becomes conspicuous changes depending on the material of the conductive film, the type and concentration of reducing gas, the temperature of the substrate, and the like. Hence, how to set the group of x-direction wirings is properly determined in consideration of these conditions.

The image forming apparatus fabricated by the method of Example 8 was confirmed to display a high-quality image, similar to Example 7.

As has been described above, the fabrication method according to the present invention can shorten the process time of the forming step. At the same time, this method can make heat generated on the substrate during the forming step almost uniform without concentrating heat at part of the substrate during the forming step. As a result, thermal deformation and destruction of the substrate can be prevented. The forming process in a reducing gas can be applied to even a large-size electron source fabricated. Consequently, a large-size electron source having good, uniform electron emission characteristics, and an image forming apparatus using this electron source can be fabricated.

What is claimed is:

1. A method of manufacturing an electron source, the method comprising the steps of:

(A) preparing a substrate on which a plurality of pairs of electrodes are arranged, the substrate being a glass substrate;

(B) forming a plurality of x-direction wirings on a surface of the substrate so as to connect one electrode of at least one pair of electrodes to one of the plurality of x-direction wirings;

(C) forming a plurality of y-direction-wirings crossing the x-direction wirings so as to connect another one electrode of the at least one pair of electrodes to one of the plurality of y-direction wirings;

(D) arranging a plurality of electroconductive films on the surface of the substrate to connect respective electrode pairs, so that the plurality of electroconductive films are attached to the surface of the substrate;

(E) flowing an electric current across each of the electroconductive films through the x-direction wirings and the y-direction wirings wherein step (E) further comprises the steps of:

(F) assigning all of the x-direction wirings to M groups, each of which includes a plurality of the x-direction wirings, wherein M is an arbitrary integer not smaller than 5, (G) selecting one group from the M groups and then applying a voltage simultaneously to all of the x-direction wirings assigned to the selected one group, wherein step (G) is repeatedly performed until the voltage has been applied to all of the x-direction wirings, wherein between any of the x-direction wirings assigned to the selected one group, at least one x-direction wiring assigned to another group is disposed, wherein none of the x-direction wirings assigned to the n-th selected one of the M groups is adjacent to any one of x-direction wirings assigned to an n+1th selected one of the M groups, and n is an arbitrary integer not less than one and not more than M−1.

2. A method according to claim 1, where in step (G), the voltage is repeatedly applied to a selected one group at predetermined time intervals.

3. A method according to claim 2, wherein the step of applying a voltage simultaneously is performed such that, after a termination of a time period during which the voltage is applied to the x-direction wirings of a selected group, a time period for applying the voltage to the x-direction wirings of another selected group begins.

4. A method according to either claim 1 or 2, wherein between times when the voltage is applied to each x-direction wiring assigned to a group, the voltage is simultaneously applied to each x-direction wiring assigned to another selected group.

5. A method of fabricating an image display apparatus comprising an electron source and an image forming member, wherein said electron source is manufactured according to the method of any one of claims 1–3.

6. A method according to claim 5, wherein, for at least one of the selected groups, the step of simultaneously applying is performed by applying the voltage to each x-direction wiring assigned to that at least one group a plurality of times at predetermined time intervals.

7. A method according to claim 5, wherein the step of simultaneously applying is performed such that, after a termination of a time period during which the voltage is applied to a selected group, a time period for applying the voltage to the x-direction wirings of another selected group begins.

8. A method according to claim 5, wherein between times when the voltage is applied to each x-direction wiring assigned to a group, the voltage is simultaneously applied to each x-direction wiring assigned to another selected group.

9. A method according to claim 6, wherein the voltage has at least two values.

10. A method according to claim 9, wherein the voltage increases gradually.

11. A method according to claim 5, wherein the voltage is constant.

12. A method according to claim 5, wherein the conductive films have respective gaps, each conductive film is formed from an oxide, and the formation of the gaps occurs in an atmosphere in which a gas reducing the oxide contacts the conductive film.

13. A method according to claim 12, wherein the gas reducing the oxide contains hydrogen.

14. A method according to claim 5, further comprising an activation step of applying a voltage to each of the conductive films within an atmosphere in which a gas containing an organic substance contacts a portion near a fissure, to cause a carbon film to be formed on the conductive film near the fissure.

15. A method according to claim 14, wherein in the activation step, the voltage applied to each conductive film is a bipolar voltage.

* * * * *

UNITED STATES PATENT AND TRADEMARK OFFICE

CERTIFICATE OF CORRECTION

PATENT NO. : 6,878,028 B1
DATED : April 12, 2005
INVENTOR(S) : Fujii et al.

It is certified that error appears in the above-identified patent and that said Letters Patent is hereby corrected as shown below:

Column 1,
Line 32, "Molybdenium" should read -- Molybdenum --.

Column 2,
Line 29, "field" should read -- filed --.

Column 4,
Line 46, "are exist" should read -- exist --.

Column 5,
Line 8, "shorten" should read -- shortened --.

Column 8,
Line 17, "$In_2 O_3$" should read -- $In_2O_3$ --.

Column 9,
Line 9, "effect" should read -- affect --.

Column 11,
Line 42, "$SO_2$" should read -- $SiO_2$ --.

Column 13,
Line 5, "groups" should read -- groups and --.

Signed and Sealed this

Fourth Day of April, 2006

JON W. DUDAS
*Director of the United States Patent and Trademark Office*